US012320198B2

(12) United States Patent
Glaser

(10) Patent No.: US 12,320,198 B2
(45) Date of Patent: Jun. 3, 2025

(54) THREADED 2 PIECE BIT ASSEMBLY

(71) Applicant: Halliburton Energy Services, Inc., Houston, TX (US)

(72) Inventor: Mark Christopher Glaser, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/326,775

(22) Filed: May 31, 2023

(65) Prior Publication Data

US 2024/0401412 A1 Dec. 5, 2024

(51) Int. Cl.

| | |
|---|---|
| ***E21B 10/26*** | (2006.01) |
| ***E21B 4/16*** | (2006.01) |
| ***E21B 7/06*** | (2006.01) |
| ***E21B 23/01*** | (2006.01) |

(52) U.S. Cl.
CPC ..... *E21B 10/26* (2013.01); *E21B 4/16* (2013.01); *E21B 7/061* (2013.01); *E21B 23/01* (2013.01)

(58) Field of Classification Search
CPC ..... E21B 10/26
See application file for complete search history.

(56) References Cited

U.S. PATENT DOCUMENTS 513,987 A * 2/1894 Creed ..... E21B 10/325 175/398
1,290,412 A * 1/1919 Trakimas ..... E21B 10/44 175/388
1,607,791 A * 11/1926 Smith ..... E21B 10/66 175/258
1,821,474 A * 9/1931 Mercer ..... E21B 10/34 175/356
2,496,954 A * 2/1950 Prassel ..... E21B 10/32 175/286
2,638,327 A * 5/1953 Baldwin ..... E21B 10/32 175/406
2,790,623 A * 4/1957 Pate ..... E21B 31/107 175/298

(Continued)

FOREIGN PATENT DOCUMENTS

WO 03036017 A1 5/2003

OTHER PUBLICATIONS

Wang, Y., et al., "A Special Thread Design for Failure Prevention of Expandable Casing," Alexandria Engineering Journal, Jul. 2, 2020, 13 pages, Elsevier.

*Primary Examiner* — Kenneth L Thompson
(74) *Attorney, Agent, or Firm* — Scott Richardson; Parker Justiss, P.C.

(57) ABSTRACT

Provided is a two part drilling and running tool, a downhole tool, a well system, and a method for forming a well system. The two part drilling and running tool, in at least one aspect, includes a conveyance, a smaller assembly coupled to an end of the conveyance, the smaller assembly having a collection of threads located proximate a downhole end thereof, the collection of threads configured to help engage and/or disengage from a wellbore tool positioned there below. The downhole tool, in accordance with this aspect, further includes a larger bit assembly slidably coupled to the conveyance, the smaller assembly and larger bit assembly configured to slidingly engage one another downhole to form a combined bit assembly.

22 Claims, 36 Drawing Sheets

(56) References Cited

U.S. PATENT DOCUMENTS

| | | | | |
|---|---|---|---|---|
| 2,994,389 | A * | 8/1961 | Bus, Sr. | E21B 10/26 175/321 |
| 3,933,395 | A * | 1/1976 | Evans | E21B 17/1078 175/325.2 |
| 4,844,179 | A * | 7/1989 | Forrest | E21B 17/1078 175/325.2 |
| 6,050,334 | A | 4/2000 | McGarian et al. | |
| 7,124,827 | B2 | 10/2006 | Braddick | |
| 7,677,335 | B2 | 3/2010 | Cao et al. | |
| 8,863,851 | B2 | 10/2014 | Davis et al. | |
| 9,261,208 | B1 | 2/2016 | Nations, Jr. et al. | |
| 10,385,651 | B2 | 8/2019 | Smith et al. | |
| 11,021,929 | B2 * | 6/2021 | Gosselin | E21B 17/1078 |
| 2003/0098152 | A1 | 5/2003 | Kennedy et al. | |
| 2006/0237234 | A1 | 10/2006 | Denis et al. | |
| 2008/0173481 | A1 | 7/2008 | Menezes et al. | |
| 2016/0237770 | A1 | 8/2016 | Korf | |
| 2019/0085661 | A1 | 3/2019 | Dancer | |

* cited by examiner

THREADED 2 PIECE BIT ASSEMBLY

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores (e.g., secondary wellbores) extending from a main wellbore (e.g., primary wellbore). A lateral wellbore is a wellbore that is diverted from the main wellbore or another lateral wellbore.

Lateral wellbores are typically formed by positioning one or more deflector assemblies (e.g., whipstock assemblies) at desired locations in the main wellbore (e.g., an open hole section or cased hole section) with a running tool. The deflector assemblies are often laterally and rotationally fixed within the primary wellbore using an anchoring assembly.

BRIEF DESCRIPTION

Reference is now made to the following descriptions taken in conjunction with the accompanying drawings, in which.

DETAILED DESCRIPTION

Figure 1:
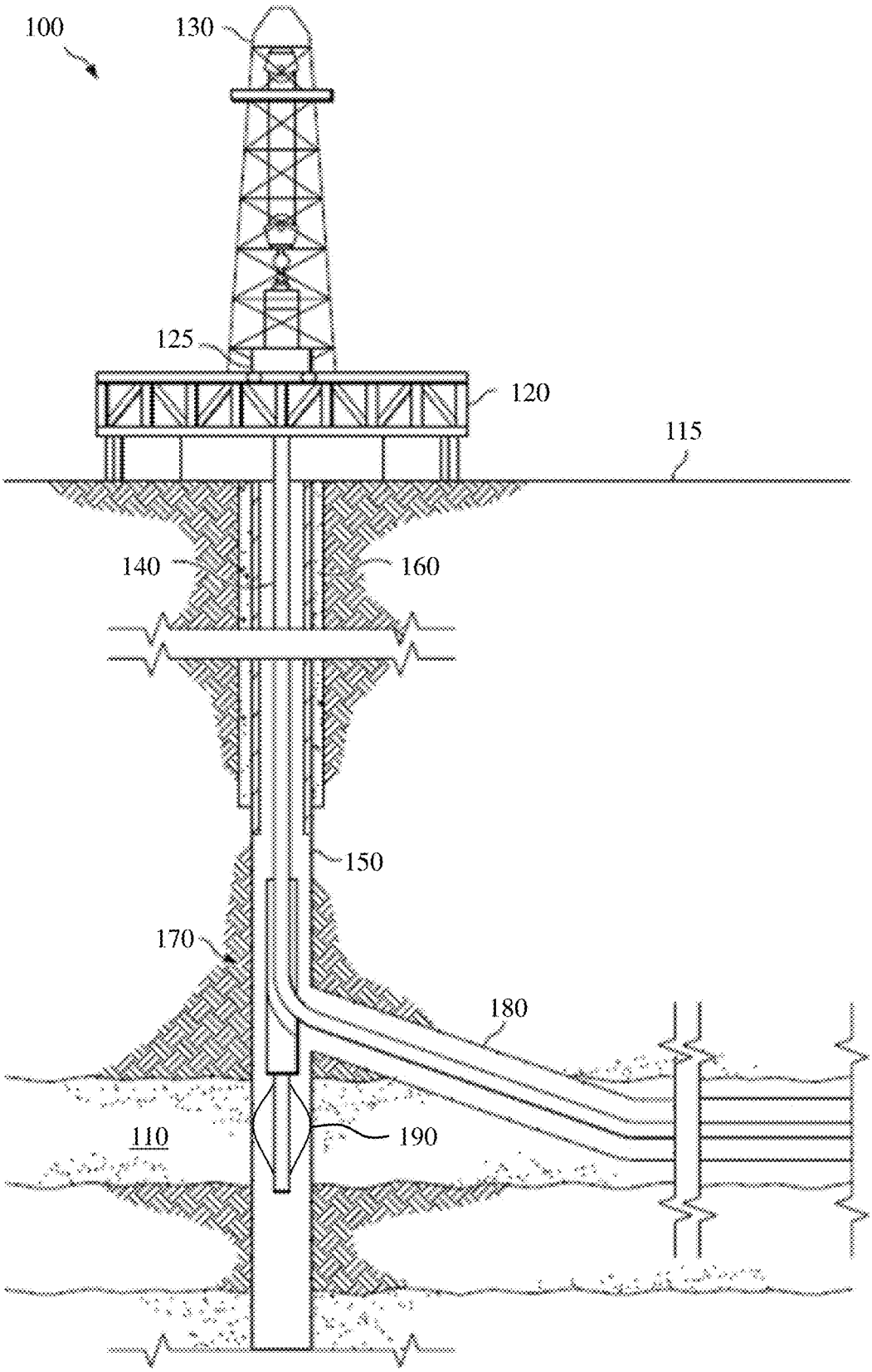
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

The disclosure addresses the challenge of running a whipstock assembly on a mill, for example in an effort to reduce trip count. Current designs for shear bolting a whipstock assembly to a mill leave the shear bolt vulnerable to combined loading, which can cause unreliable shear values. Also, current shear bolts are unsuitable for deploying whipstock assembly in extremely deep wells because of the low shear ratings. In addition, the disclosure allows for certain tools to be activated with pressure or flow, further improving efficiencies in the construction of a multilateral junction.

With this in mind, the present disclosure provides a two part drilling and running tool (e.g., two-part lead bit assembly) that can be used to run a whipstock assembly downhole. In at least one embodiment, the smaller assembly (e.g., downhole/smaller bit assembly) is connected to the whipstock assembly, and in certain embodiments downhole of the whipstock assembly (e.g., anchoring assembly, liner assembly, etc.), and functions as a running tool. The smaller assembly, in certain embodiments, also seals into the whipstock assembly allowing pressure or flow, or a combination thereof, to be used to activate or otherwise interact with one or more tools below the whipstock assembly. Once released, the smaller assembly pulls back and connects to a larger bit assembly (e.g., uphole/larger bit assembly) thereby forming a new combined bit assembly (e.g., that looks and functions like a conventional lead mill). For purposes of the present disclosure, the term bit assembly is intended to encompass both mill assemblies and drill bit assemblies. Following the successful creation of the exit and the drilling of the lateral, the lateral completion could be installed and then tied together with the main bore by installing a level 5 junction. To accomplish this, in at least one embodiment, the whipstock assembly is actually a hybrid whipstock that incorporates features of a conventional completion deflector, such as seals.

Heretofore, a two part drilling and running tool consisting of two independent assemblies (e.g., two independent bit assemblies) has not been used, and particularly where the smaller assembly (e.g., smaller bit assembly) can function as a running tool for a whipstock assembly and downhole tools there below. The two part drilling and running tool described herein ensures reliable deployment of a whipstock assembly and/or liner assembly. Also, it greatly increases the mechanical ratings that can be achieved while running in hole, thereby allowing the whipstock assembly to be deployed into deeper or highly deviated wells. It would also be feasible to connect more components to the whipstock assembly without risking premature shearing of the shear bolt.

Additionally, for a reentry well where an anchoring assembly needs to be set first, the ability to apply pressure down the tool string would save a further trip by combining the anchoring assembly setting and first pass milling operations into one trip. Moreover, an additional trip is saved, in one or more embodiments, by being able to land the junction into the hybrid whipstock assembly/deflector.

One embodiment of the disclosure would feature a smaller assembly and a larger bit assembly. In accordance with at least one embodiment of the disclosure, the smaller assembly is a smaller bit assembly having one or more cutting features (e.g., teeth, blades, etc.) thereon. The smaller assembly, in one embodiment, would be connected to a conveyance (e.g., tubular) that extends through the larger bit assembly and is then connected to the rest of the drill string, or perhaps to a downhole motor directly. In at least one embodiment, the smaller assembly is sized such that it can wholly or partially fit into the bore of the whipstock assembly, such that in one embodiment it may connect to the whipstock assembly or there below.

In at least one embodiment, the smaller assembly is coupled to the whipstock assembly or other downhole device there below using a threaded connection. For example, the smaller assembly could include one or more male threads, wherein the whipstock assembly or other device there below could have female threads, or vice-versa. In at least one embodiment, the threads on the smaller assembly are left handed threads. Accordingly, the smaller assembly could be disconnected from the whipstock assembly or other downhole device there below using a right hand drill string. For example, as the drill string rotates to the right, the smaller assembly would back out of the whipstock assembly or other downhole device there below.

With the smaller assembly free from the whipstock assembly or other downhole device there below, the smaller assembly is free to slide back uphole and into the larger bit assembly. In one or more embodiments, the threads in the smaller assembly engage with related threads in the larger bit assembly, to axially and/or rotationally fix the two together. In at least one embodiment, the right hand turn of the drill string couples and holds the smaller assembly with the larger bit assembly. While left hand threads have been described above, right hand threads could be used, but in doing so a left hand drill string would be needed.

In one or more other embodiments, a collection of splines and slots in the smaller assembly and the larger bit assembly engage with one another to rotationally fix the smaller assembly with the larger bit assembly. In such an embodiment, a snap ring or other retaining feature may be added to axially fix the smaller assembly with the larger bit assembly. In this embodiment, the threads in the smaller assembly might have no function once the smaller assembly and larger bit assembly are fixed to one another.

The smaller assembly, in one or more embodiments, could also feature the ability to seal into the whipstock assembly. In one simple embodiment, the smaller assembly would have a seal surface that stabs into a seal in the whipstock assembly. Once the whipstock assembly has been positioned in the well, pressure could be applied to activate an anchoring assembly. In reentry or open hole applications this is often a requirement, as there would not be a preposition datum in the well such as a latch coupling. In yet another embodiment, the smaller assembly would have a seal that stabs into a seal surface of the whipstock assembly.

In at least one embodiment, the whipstock assembly would be run in hole to the depth datum in the well and then latched in. One possible embodiment of this would be a multilateral latch coupling, or another similar latch. Unlike existing shear bolt designs, here the threads of certain embodiments herein would be protected from combined loading. For example, the threads can be included into the design of the smaller assembly and the whipstock assembly to ensure that the threads will only release under a single condition, such as for example the right hand turning of the drill string.

In at least one embodiment, the larger bit assembly, is also secured to the tip of the whipstock assembly. Those familiar with multilateral shear bolt systems will recognize this as the traditional placement of a shear bolted mill. Nevertheless, since the larger bit assembly is not used for running the whipstock assembly, a robust connection at the larger bit assembly is not required in certain embodiments, and thus may be dispensed with.

The larger bit assembly, in at least one embodiment, only needs to remain stationary relative to the smaller assembly as the smaller assembly is being pulled back (e.g., uphole). Therefore, many different methods may be used to hold the larger bit assembly stationary. Several other non-limiting examples are listed below. As the smaller assembly is pulled back, it mostly enters the larger bit assembly. At this point, the external appearance of the two bit assemblies put together would very closely resemble that of a conventional lead mill in one or more embodiments. Since existing lead mills have been developed over many years it is presumed that this shape is optimized for the task of creating an exit from the main bore of a well. However, variations may be possible, either to incorporate the two-part design or to keep up with latest designs in conventional single part mills.

Once the smaller assembly has been fully retracted into the larger bit assembly it can be secured to the larger bit assembly for the milling operation. In at least one embodiment, a simple snap ring falls into a groove in the smaller assembly, thereby securing (e.g., laterally securing) the smaller assembly within the larger bit assembly. Many alternate methods are obviously possible, such as spring-loaded pins, a thread, or an interference fit between the two bit assemblies. In at least one embodiment, an external profile on the smaller assembly could mate with an internal profile in the larger bit assembly to lock the two bit assemblies together (e.g., torsionally securing the smaller assembly and the larger bit assembly).

At this point the larger bit assembly may be disconnected from the whipstock assembly tip and a normal window can be milled in the casing and/or formation as is current industry practice. As is sometimes the practice with milling windows, secondary mills (e.g., watermelon mills) may be added to follow the lead mill to ensure proper window geometry. Likewise multiple trips may be required to successfully mill a window. In those cases, extra mills or trips could be performed as is done today. Thereafter, the remainder of the multilateral construction may be completed, for example including placing a multilateral junction including a mainbore leg and a lateral bore leg at the junction between the main wellbore and the lateral wellbore.

Up to this point, the use of a two part drilling and running tool has been discussed for creating an exit window from a cased mainbore. An alternate use for this new technology is to sidetrack from an open-hole main bore. In this alternate use, the bit assembly would be more appropriately called a drill bit, as it would be drilling formation to exit the main bore rather milling casing. This would be useful for simple sidetracking where the main bore may need to be abandoned, or it may be used during the construction of an open-hole multilateral junction. In this use, the smaller assembly and larger bit assembly would be designed differently than what is shown here to closely resemble a drill bit instead of a mill bit. This would necessitate certain changes to the external cutting features, which should be understood to not deviate from the core features described herein.

While the previously mentioned seal surface and seal set up is workable, it could be reversed with the seal instead attached to the mill and a seal bore in the whipstock assembly. It is also understood that there are other methods to affect a seal between two parts that could work here as well. Or it is also conceivable that for some applications a perfect "pressure tight" seal might not be needed at all, and simply having the smaller assembly and whipstock assembly in very close contact is enough to allow enough pressure or flow to be conveyed to achieve the desired effect on the tool below the whipstock assembly.

As mentioned above, there are many different methods and mechanisms known to the industry for securing tubular tools to each other. This also applies when it comes to securing the smaller assembly to the larger bit assembly in preparation for milling. For applications where the whipstock assembly needs to be removed following the drilling of the short rat hole, the present concept may be set up to allow the smaller assembly to disconnect from the whipstock assembly, connect to the larger bit assembly, and then following the completion of the milling/drilling, disconnect from the larger bit assembly again and then again reconnect to the whipstock assembly for its retrieval.

In at least one embodiment, the two part drilling and running tool can drill a lateral section on its own without the need for dedicated drill out run. Incorporating one of the mechanical movements described above into the smaller assembly would allow for this functionality.

Additionally, there are many anchoring assembly mechanisms (e.g., within Halliburton multilateral technology alone there are 4 different anchoring assembly mechanisms) for providing the datum for the construction of a multilateral junction. The latch coupling discussed herein is just one, but based on the particular well and requirements, any of the other methods would work just as well and not impact the use of the two part drilling and running tool presented here. For example, other hydraulic actuated anchor assemblies, including traditional anchor assemblies and screen based anchor assemblies, could be used as the anchoring assembly mechanism.

One or more hydraulic actuated anchoring assemblies designed according to the present disclosure may have a setting range of 15% or more of the run-in-hole diameter. For example, if the wellbore anchoring assembly were to have a diameter (x) when run in hole, the expanded diameter (x') could be 1.15x or more (e.g., 8.5" to 10" or more). Washed out/caved in areas or uneven ID in general is often seen when surveying a drilled section and finding a suitable location/depth for an open hole anchoring assembly can thus be difficult. Furthermore, the traditional open hole wellbore anchoring assembly relies on a certain formation strength of the rock in order to hold the required axial and torsional loads.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based and/or water-based well systems different from that illustrated.

As shown, a main wellbore 150 has been drilled through the various earth strata, including the subterranean formation 110. The term "main" wellbore is used herein to designate a primary wellbore from which another secondary wellbore is drilled. It is to be noted, however, that a main wellbore 150 does not necessarily extend directly to the earth's surface, but could instead be a branch of yet another lateral wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A whipstock assembly 170 according to one or more embodiments of the present disclosure may be positioned at a location in the main wellbore 150. Specifically, the whipstock assembly 170 could be placed at a location in the main wellbore 150 where it is desirable for a lateral wellbore 180 to exit. Accordingly, the whipstock assembly 170 may be used to support a drilling/milling tool used to penetrate a window in the main wellbore 150. In at least one embodiment, once the window has been milled and a lateral wellbore 180 formed, the whipstock assembly 170 may be retrieved and returned uphole by a retrieval tool, in some embodiments in only a single trip.

In some embodiments, an anchoring assembly 190 may be placed downhole in the wellbore 150 to support and anchor downhole tools, such as the whipstock assembly 170, for maintaining the whipstock assembly 170 in place while milling the casing 160 and/or drilling the lateral wellbore 180. The anchoring assembly 190, in accordance with the disclosure, may be employed in a cased section of the main wellbore 150, or may be located in an open-hole section of the main wellbore 150, as is shown. As such, the anchoring assembly 190 in at least one embodiment may be configured to resist at least 6,750 newton meters (Nm) (e.g., about 5,000 lb-ft) of torque. In yet another embodiment, the anchoring assembly 190 may be configured to resist at least 13,500 newton meters (Nm) (e.g., about 10,000 lb-ft) of torque, and in yet another embodiment configured to resist at least 20,250 newton meters (Nm) (e.g., about 15,000 lb-ft) of torque. Similarly, the anchoring assembly 190 may be configured to resist at least 1814 kg (e.g., about 4,000 lb) of axial force. In yet another embodiment, the anchoring assembly 190 may be configured to resist at least 4536 kg (e.g., about 10,000 lb) of axial force, and in yet another embodiment the anchoring assembly 190 may be configured to resist at least 6804 kg (e.g., about 15,000 lb) of axial force.

In the illustrated embodiment, the anchoring assembly 190 may be a hydraulically activated anchoring assembly. In this embodiment, once the anchoring assembly 190 reaches a desired location in the main wellbore 150, fluid pressure may be applied to set the hydraulic anchoring assembly. In at least one embodiment, the hydraulically activated anchoring assembly includes two or more hydraulic activation chambers, and the activation fluid is supplied to the two or more hydraulic activation chambers (e.g., through a two-part milling assembly coupled to the whipstock assembly 170) to move the two or more hydraulic activation chambers from the first collapsed state to the second activated state and engage a wall of the main wellbore 150. The anchoring assembly 190 may also include, in some embodiments, an expandable medium positioned radially about the two or more hydraulic activation chambers. In some aspects, the expandable medium may be configured to grip and engage the wall of the main wellbore 150 when the two or more hydraulic activation chambers are in the second activated state. Notwithstanding, other fluid activated anchoring assemblies (e.g., other than those having two or more hydraulic activation chambers) may be used and remain within the scope of the disclosure. In at least one other embodiment, the hydraulically activated anchoring assembly includes one or more hydraulic activation slips, and the activation fluid is supplied to the one or more hydraulic activation slips (e.g., through a two-part milling assembly coupled to the whipstock assembly 170) to move the one or more hydraulic activation slips from the first collapsed state to the second activated state and engage the wall of the main wellbore 150.

Furthermore, mechanical activated anchoring assemblies could also be used and remain within the scope of the disclosure. For instance, in yet other embodiments, the anchoring assembly 190 is a latch coupling. In this embodiment, the latch coupling (e.g., a profile in the casing engages with a reciprocal profile in the whipstock assembly 170) anchors the whipstock assembly 170, and any other features hanging there below (e.g., screens, valves, etc.) in the casing string 160. Once the anchoring assembly 190 reaches a desired location in the main wellbore 150, the reciprocal profile in the whipstock assembly 170 may be activated to engage with the latch coupling profile in the casing string 160, thereby setting the anchoring assembly 190. Thus, in at least one embodiment, the anchoring assembly 190 is not hydraulically activated, but is mechanically activated.

In at least one embodiment, a multilateral junction is positioned at an intersection between the resulting main wellbore 150 and the resulting lateral wellbore 180. In accordance with one embodiment, the multilateral junction might include a main bore leg forming a first pressure tight seal with the main bore completion and a lateral bore leg forming a second pressure tight seal with the lateral bore completion, such that the main bore completion and the lateral bore completion are hydraulically isolated from one another. What results, in one or more embodiments, is an open hole TAML Level 5 pressure tight junction.

Figure 2A:
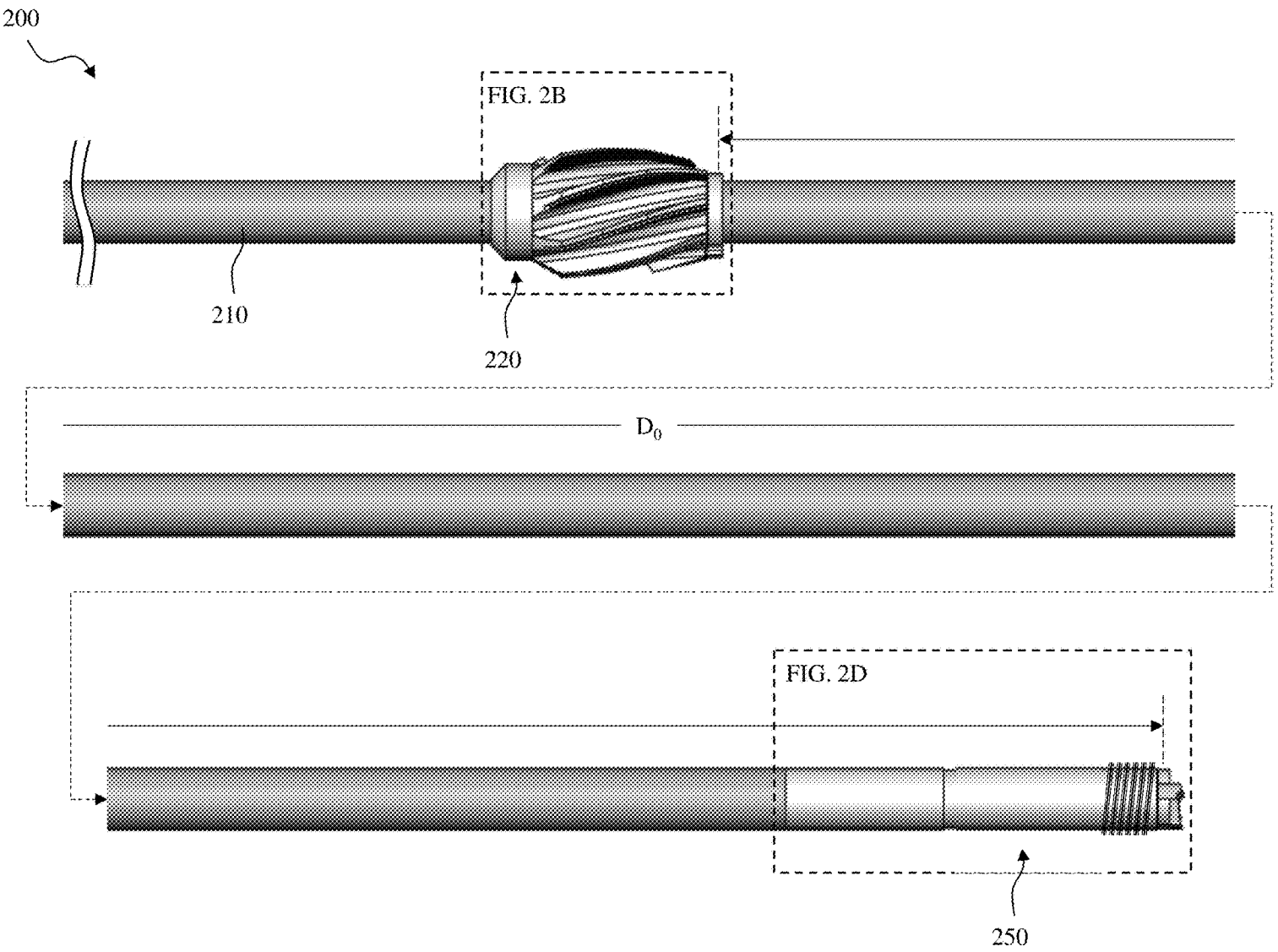
FIGS. 2A through 7B illustrate various different views of a two part milling and running tool designed, manufactured and operated according to one or more embodiments of the disclosure.

Turning to FIG. 2A, illustrated is a side view of a two part milling and running tool 200 designed, manufactured and operated according to one or more embodiments of the disclosure. The two part milling and running tool 200, in the illustrated embodiment, includes a conveyance 210 having a larger bit assembly 220 and a smaller assembly 250 coupled thereto. The phrase "bit assembly," as used herein, is intended to include both milling assemblies (e.g., as might be used to mill through casing) and drill bit assemblies (e.g., as might be used to drill through formation), as well as any combination of the two. As discussed above, and shown in many FIGS., the smaller assembly 250 may be a smaller bit assembly, and thus may contain one or more different types of cutting features along a downhole face thereof.

The conveyance 210, in at least one embodiment, is a tubular, such as jointed pipe or coiled tubing. In the illustrated embodiment of FIG. 2A, the smaller assembly 250 is coupled to an end (e.g., coupled proximate (e.g., with 2 meters, if not within 1 meter, if not within 0.5 meters, if not within 0.1 meters) a downhole end) of the conveyance 210, whereas the larger bit assembly 220 is in sliding engagement with the conveyance 210. Accordingly, assuming that something (e.g., friction, a shear feature, etc.) is holding the larger bit assembly 220 in place, as the conveyance 210 is moved the smaller assembly 250 may slide relative to the larger bit assembly 220. For instance, if the conveyance 210 were withdrawn uphole, the larger bit assembly 220 would slide along the conveyance 210, thereby allowing the smaller assembly 250 to slide toward the larger bit assembly 220. As will be discussed in greater detail below, the two part milling and running tool 200 may be used to deploy a whipstock assembly, and thus be coupled to the whipstock assembly when running downhole. The coupling of the two part milling and running tool 200 to one of the whipstock assembly, the anchoring assembly or the wellbore liner, in at least one embodiment, would prevent the smaller assembly 250 from sliding toward the larger bit assembly 220 during the run-in-hole phase. Only when the coupling is disengaged (e.g., unthreaded) would the smaller assembly 250 be allowed to slide toward the larger bit assembly 220.

In the illustrated embodiment of FIG. 2A, the two part milling and running tool 200 is positioned in the run-in-hole position. In this run-in-hole position, the larger bit assembly 220 would be spaced apart from the smaller assembly 250 by a distance ($D_0$). In at least one embodiment, the distance ($D_0$) approximates the length of the whipstock assembly that the two part milling and running tool 200 is coupled to. According to this embodiment, the smaller assembly 250 might couple proximate a downhole end of the whipstock assembly, whereas the larger bit assembly 220 might couple proximate an uphole end of the whipstock assembly. Thus, in at least one embodiment, the distance ($D_0$) is at least 2 meters. In yet another embodiment, the distance ($D_0$) is at least 4 meters, and in even another embodiment the distance ($D_0$) is at least 5 meters. In at least one other embodiment, the distance ($D_0$) approximates the length of the whipstock assembly and at least a portion of the length of the anchoring assembly. In at least yet another embodiment, the distance ($D_0$) approximates the length of the whipstock assembly, the length of the anchoring assembly, and at least a portion of the length of the wellbore liner.

Figure 2B:
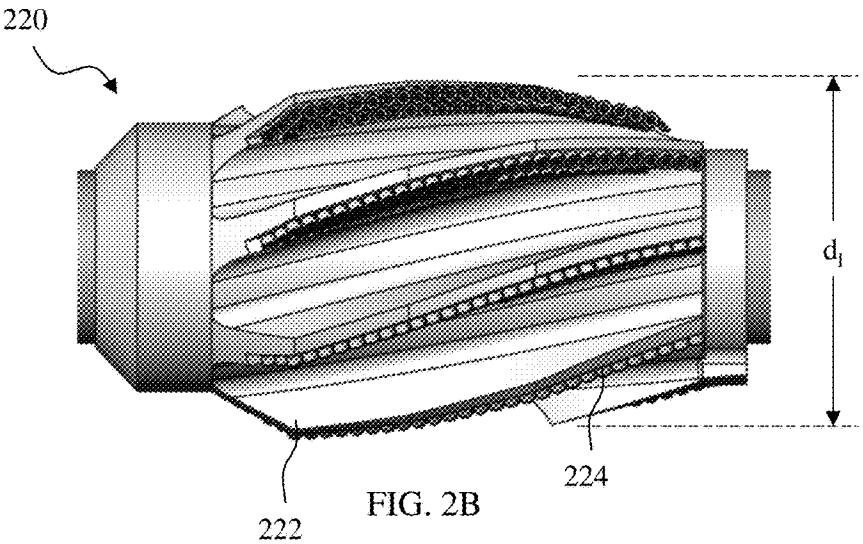

Turning now to FIG. 2B, illustrated is an enlarged side view of the larger bit assembly 220 of FIG. 2A. As is evident in FIG. 2B, the larger bit assembly 220 may have one or more blades 222 and/or one or more cutting features 224 thereon. While specific blades 222 and cutting features 224 are illustrated in FIG. 2B, any currently known or hereafter discovered blades and cutting features may be used and remain within the scope of the disclosure. The larger bit assembly 220, in the illustrated embodiment, includes a cutting diameter ($d_t$). In at least one embodiment, the cutting diameter ($d_t$) approximates the size of an opening (e.g., in the casing and/or formation) forming a lateral wellbore.

Figure 2C:
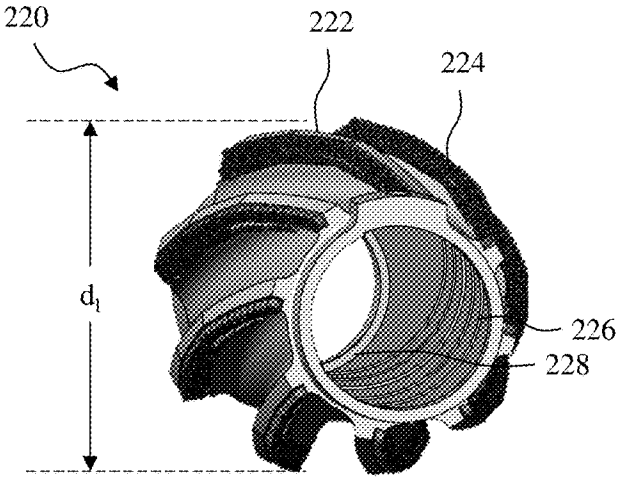

Turning now to FIG. 2C, illustrated is an isometric view of one embodiment of an internal profile of the larger bit assembly 220 of FIG. 2A. In the illustrated embodiment of FIG. 2C, the larger bit assembly 220 additionally a collection of threads 226 (e.g., a collection of left hand female threads in this embodiment). In at least one embodiment, the collection of threads 226 are configured to engage with a collection of threads in the smaller assembly 250 when the smaller assembly 250 has slid relative and proximate to the larger bit assembly 220. Furthermore, in at least one embodiment, the larger bit assembly 220 may include a lock ring profile 228, which may be configured to hold a lock ring (not shown) that could ultimately engage with an associated lock ring profile in the smaller assembly 250, or vice versa.

Figure 2D:
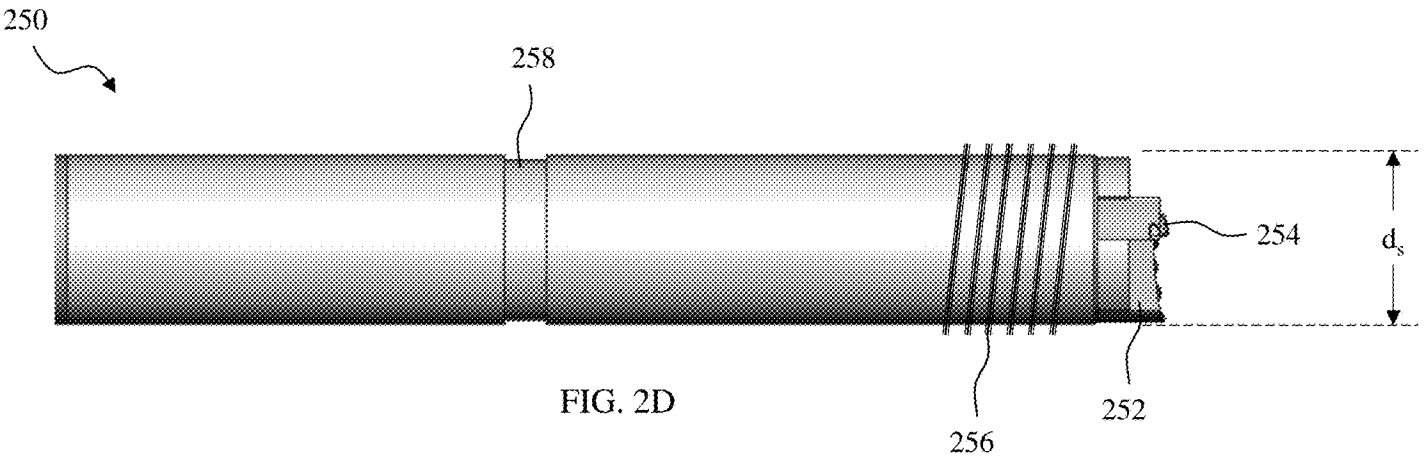

Turning now to FIG. 2D, illustrated is an enlarged side view of the smaller assembly 250 of FIG. 2A. As is evident in FIG. 2D, the smaller assembly 250 may have one or more blades 252 and one or more cutting features 254 thereon, thereby making the smaller assembly 240 a smaller bit assembly. While specific blades 252 and cutting features 254 are illustrated in FIG. 2D, any currently known or hereafter discovered blades and cutting features may be used and remain within the scope of the disclosure. The smaller assembly 250, in the illustrated embodiment, includes a cutting diameter ($d_s$). In at least one embodiment, the cutting diameter ($d_s$) is at least 10 percent less than the cutting diameter ($d_l$). In at least one embodiment, the cutting diameter ($d_s$) is at least 25 percent less than the cutting diameter ($d_l$), in yet another embodiment at least 50 percent less than the cutting diameter ($d_l$), in yet another embodiment at least 75 percent less than the cutting diameter ($d_l$), and in yet another embodiment at least 90 percent less than the cutting diameter ($d_l$).

The smaller assembly 250, as shown in FIG. 2D, may additionally include a collection of threads 256 (e.g., a collection of left hand male threads in one embodiment). In at least one embodiment, not only are the collection of threads 256 configured to engage with the collection of threads 226 of the larger bit assembly 220, the collection of threads 256 may be configured to engage with an associated collection of threads in the one of the whipstock assembly, the anchoring assembly or the wellbore liner that the smaller assembly 250 is originally engaged with.

The smaller assembly 250, in the illustrated embodiment, may further include an associated lock ring profile 258. Accordingly, the lock ring profile 258, as well as the associated lock ring profile 228 and lock ring (not shown) of the larger bit assembly 220, may be used to linearly fix the larger bit assembly 220 and the smaller assembly 250. Additionally, the collection of threads 256, as well as the collection of threads 226 of the larger bit assembly 220, may be used to rotationally fix the larger bit assembly 220 and the smaller assembly 250.

Figure 2E:
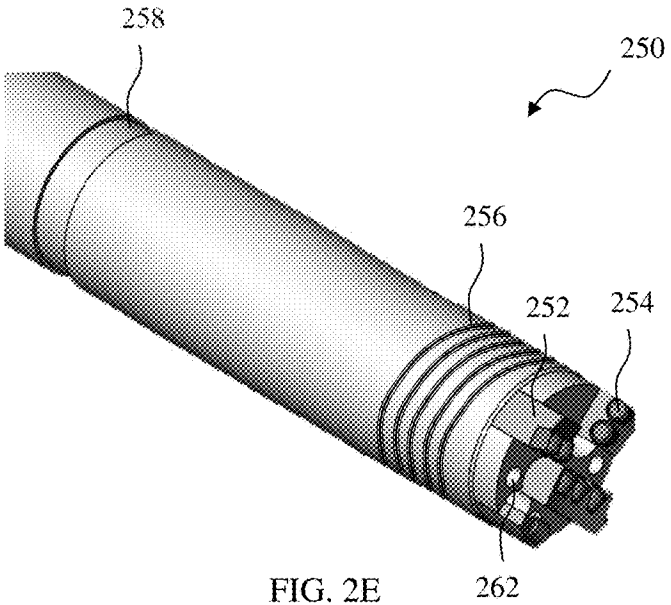

Turning now to FIG. 2E, illustrated is an isometric view of one embodiment of the smaller assembly 250 of FIG. 2A. In the illustrated embodiment of FIG. 2E, the smaller assembly 250 additionally includes one or more fluid ports 262. The one or more fluid ports 262, in the illustrated embodiment, provide fluid access past the smaller assembly 250, to help cool the bit/mill, lubricate and remove cuttings. In yet another embodiment, the one or more fluid ports 262, provide fluid access past the smaller assembly 250, particularly, when the smaller assembly 250 is coupled to and sealed with the whipstock assembly. For example, the one or more fluid ports 262 may be fluidly coupled with a through bore in the whipstock assembly, and thus may be used to activate a hydraulic wellbore anchoring assembly, among other downhole features.

Figure 3A:
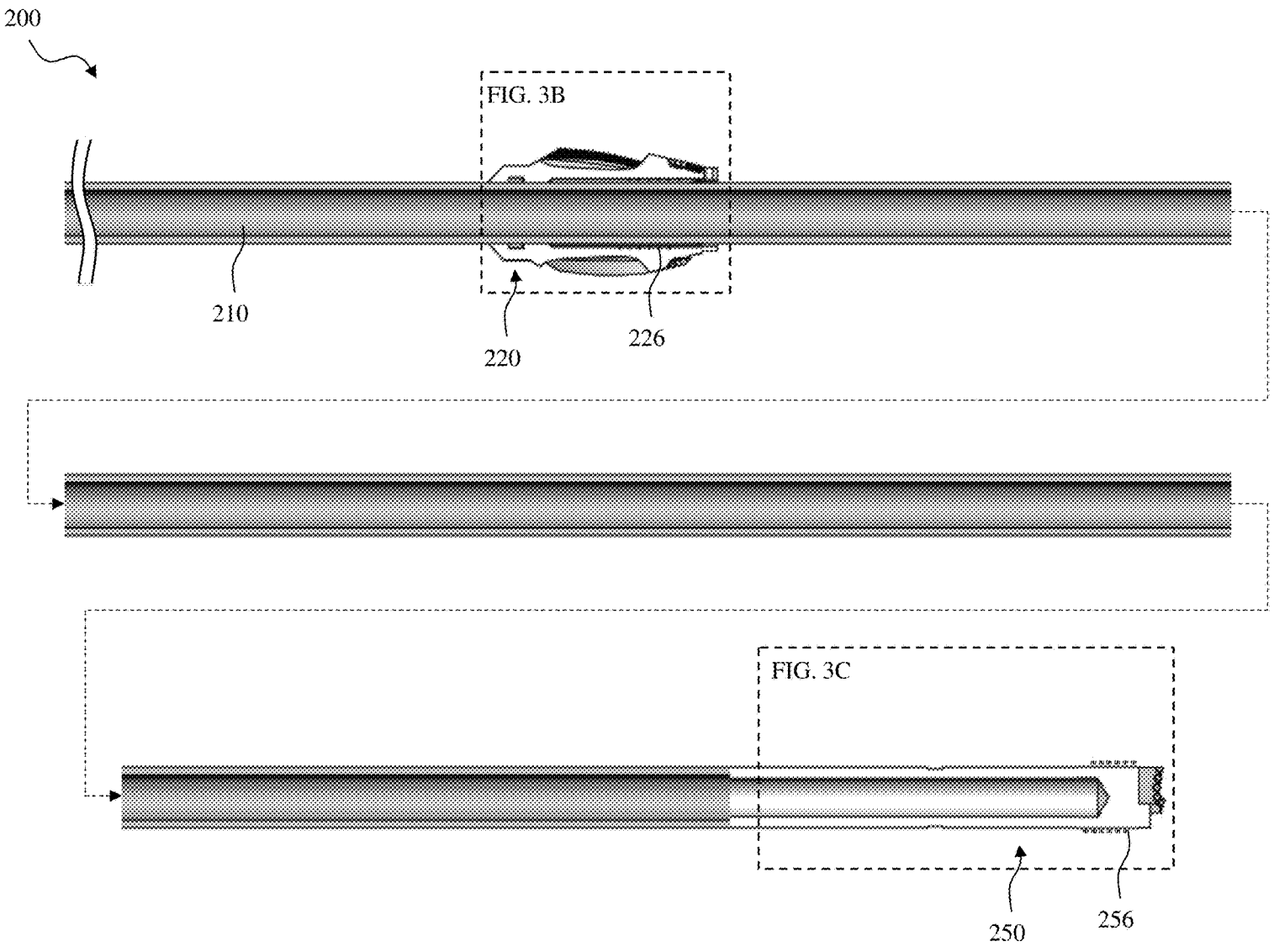

Turning to FIG. 3A, illustrated is a cross-sectional side view of the two part milling and running tool 200 of FIG. 2A.

Figure 3B:
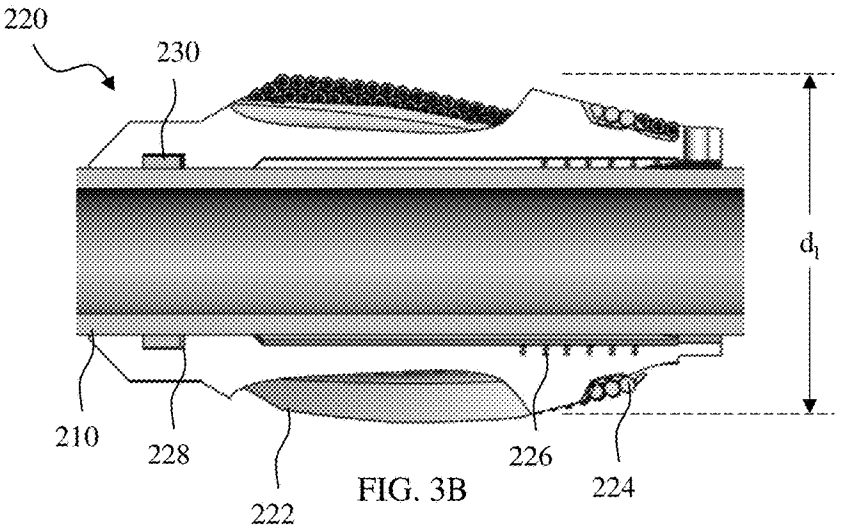

Turning now to FIG. 3B, illustrated is an enlarged side view of the larger bit assembly 220 of FIG. 3A. As can be shown in FIG. 3B, a lock ring 230 may be positioned within the lock ring profile 228, and surrounding the conveyance 210. As the conveyance 210 does not have a corresponding lock ring profile in the embodiment shown, the larger bit assembly 220 is allowed to slide along the conveyance 210 freely.

Figure 3C:
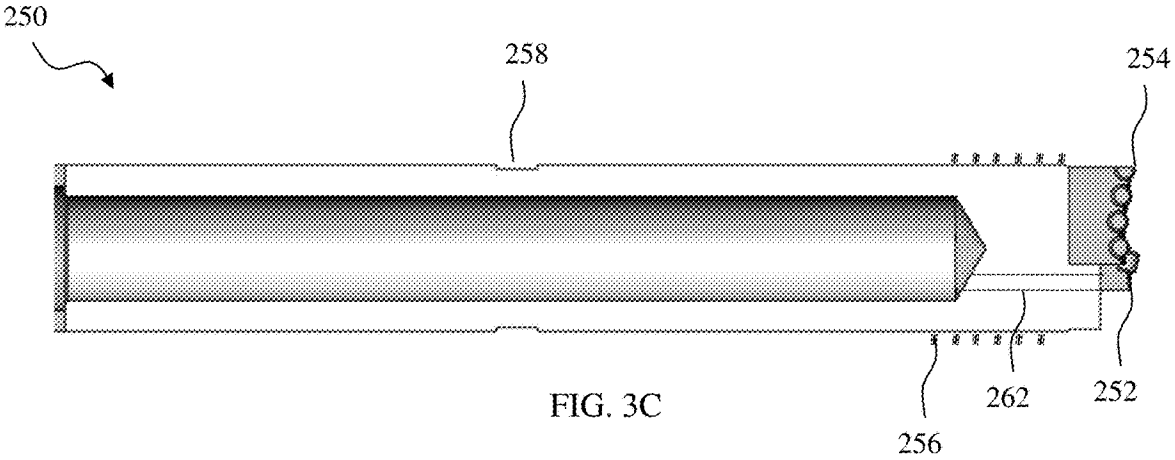

Turning now to FIG. 3C, illustrated is an enlarged side view of the smaller assembly 250 of FIG. 3A.

Figure 4:
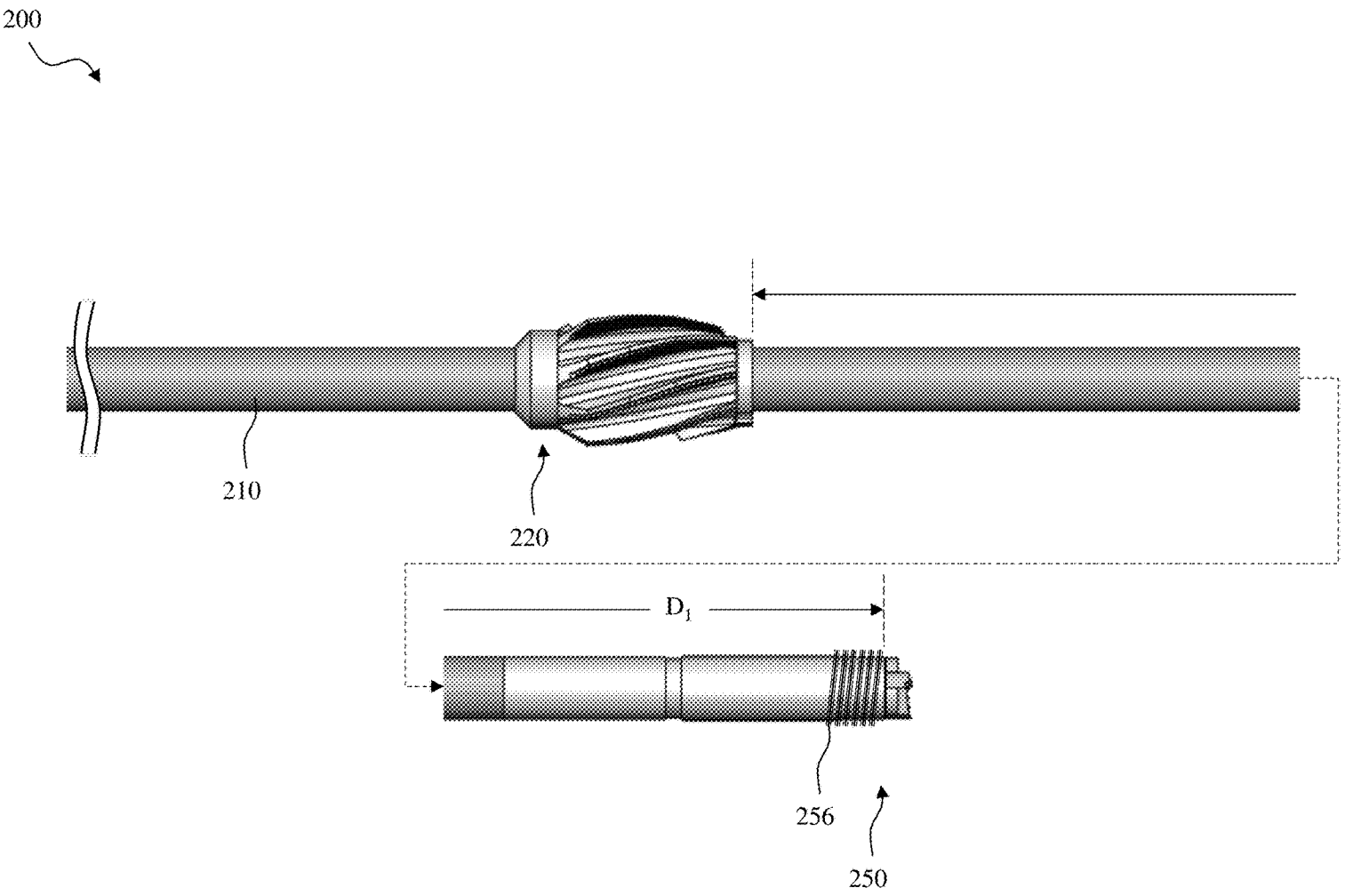

Turning to FIG. 4, illustrated is a side view of a two part milling and running tool 200 of FIGS. 2A and 3A, after the conveyance 210 has been pulled partially uphole, thereby sliding the smaller assembly 250 toward the larger bit assembly 220. In the illustrated embodiment, it is assumed that the larger bit assembly 220 is fixed in location, and that the smaller assembly 220 is sliding toward the fixed larger bit assembly 220. Such would be the case if the larger bit assembly 220 were still fixed (e.g., via friction, a shear feature, etc.) relative to the whipstock assembly. In this partially slid position, the larger bit assembly 220 would be spaced apart from the smaller assembly 250 by a distance ($D_1$). In at least one embodiment, the distance ($D_1$) is at least 50 percent less than the distance ($D_0$).

Figure 5:
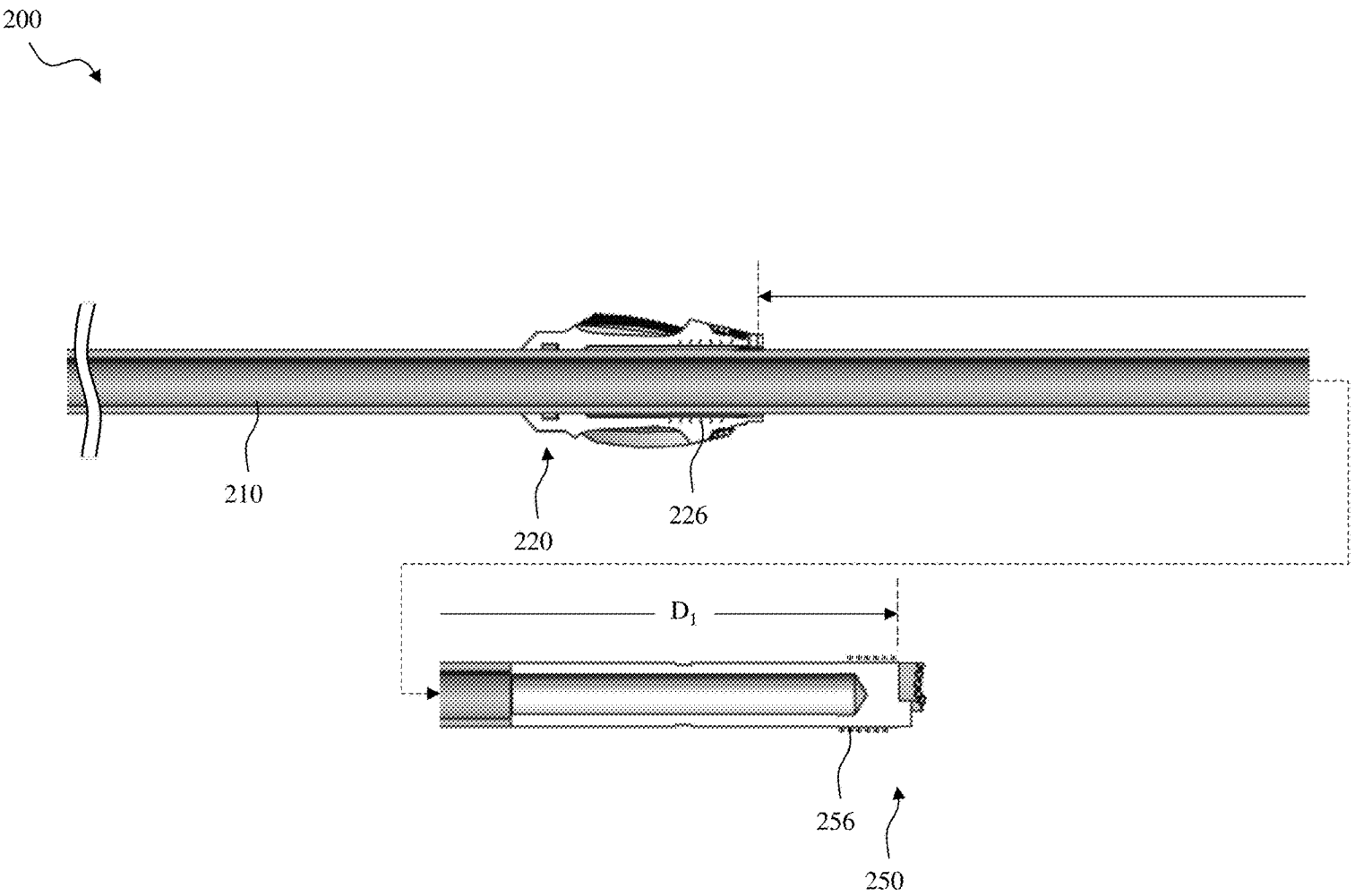

Turning to FIG. 5, illustrated is a cross-sectional side view of the two part milling and running tool 200 of FIG. 4.

Figure 6A:
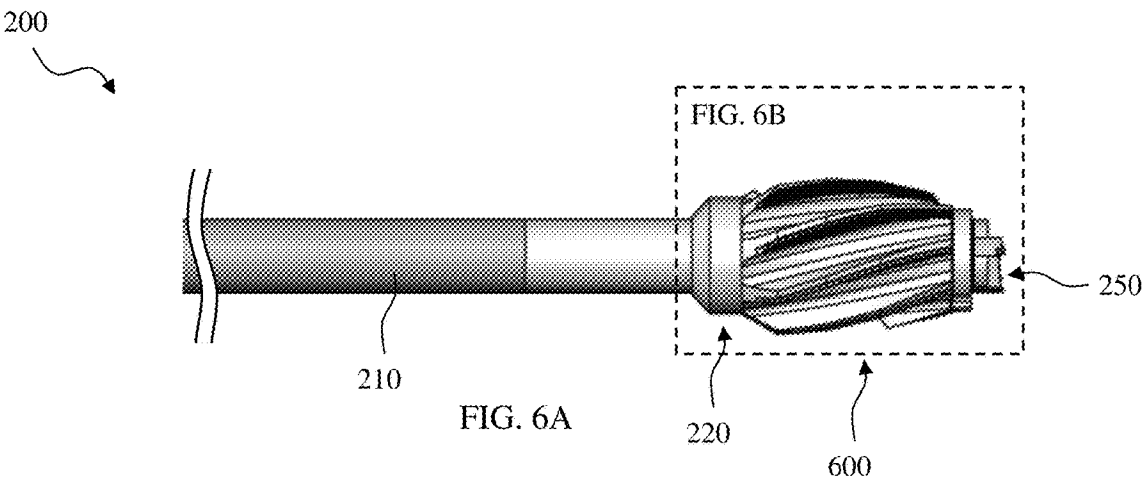

Turning to FIG. 6A, illustrated is a side view of a two part milling and running tool 200 of FIGS. 4 and 5, after the conveyance 210 has been pulled fully uphole, thereby sliding the smaller assembly 250 into engagement with the larger bit assembly 220, and thus forming a combined bit assembly 600.

Figure 6B:
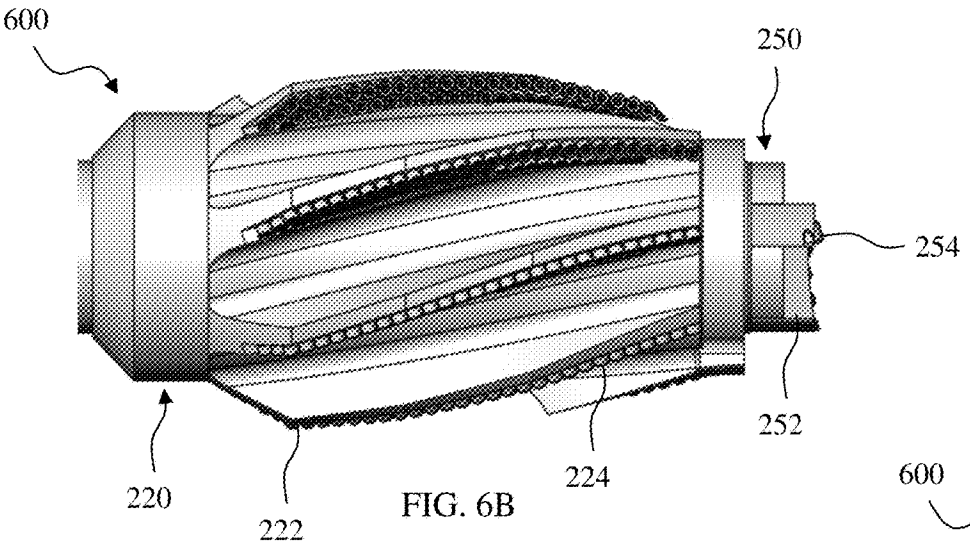

Turning now to FIG. 6B, illustrated is an enlarged side view of the combined bit assembly 600 of FIG. 6A. As shown, the smaller assembly 250 is engaged with the larger bit assembly 220. Furthermore, with the smaller assembly 250 engaged with the larger bit assembly 220, the combined bit assembly 600 may now approximate the shape of bit assemblies currently existing in the art. In at least one embodiment, the collection of threads 226 and the collection of threads 256 may engage one another to form the combined bit assembly 600. As discussed below, a right hand twisting of the conveyance 210 may cause the collection of threads 226 to engage with, and remain engaged with, the collection of threads 256. In other embodiments, the collection of threads 226, 256 are right hand threads, which would require a left hand conveyance to fix the two.

Figure 6C:
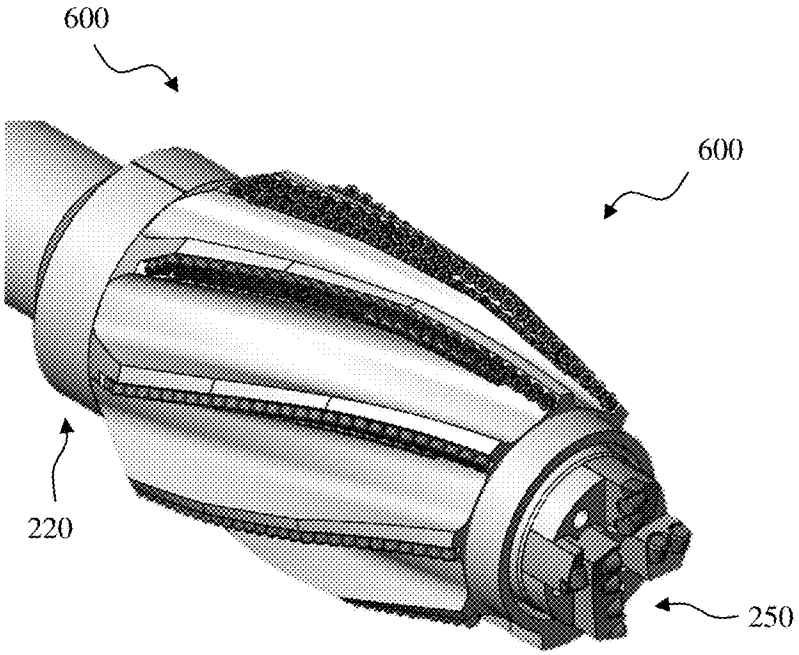

Turning now to FIG. 6C, illustrated is an isometric enlarged side view of the combined bit assembly 600 of FIG. 6A.

Figure 7A:
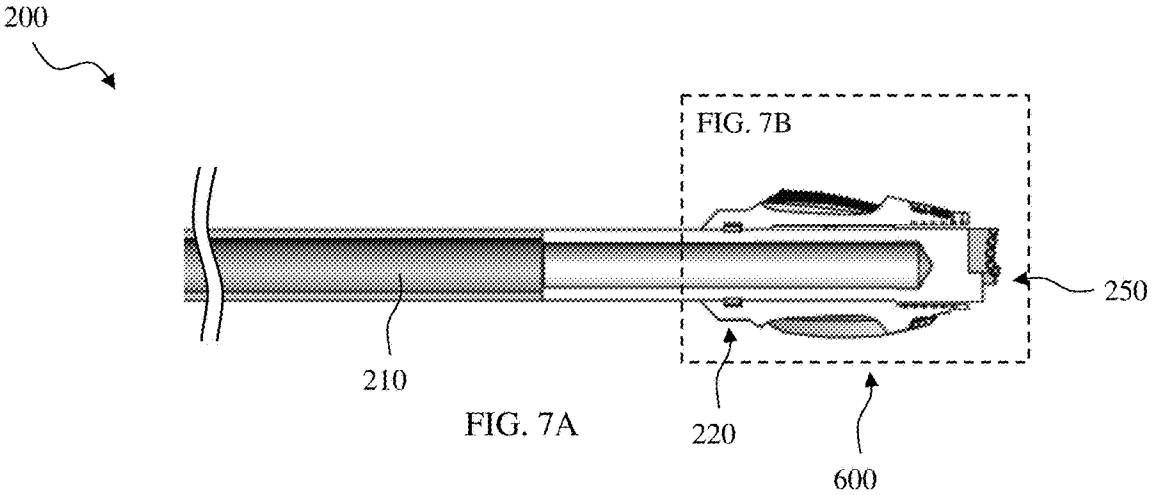

Turning to FIG. 7A, illustrated is a cross-sectional side view of a two part milling and running tool 200 of FIGS. 4 and 5, after the conveyance 210 has been pulled fully uphole, thereby sliding the smaller assembly 250 into engagement with the larger bit assembly 220, thereby forming the combined bit assembly 600.

Figure 7B:
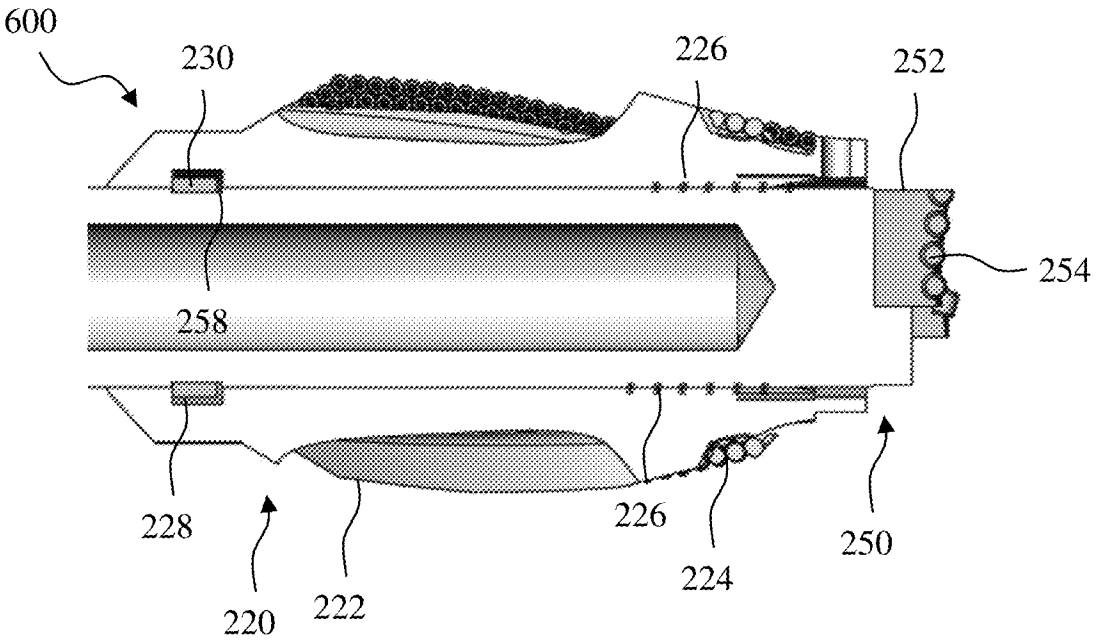

Turning now to FIG. 7B, illustrated is an enlarged cross-sectional side view of the combined bit assembly 600 of FIG. 7A. As shown in FIG. 7B, the lock ring 230 may snap into the associated lock ring profile 258 in the smaller assembly 250, and thus axially fix the smaller assembly 250 relative to the larger bit assembly 220.

Turning now to FIGS. 8 through 19, illustrated are different views of a well system 800, the well system 800 employing a two part drilling and running tool, for example to form a lateral wellbore therein.

Figure 8:
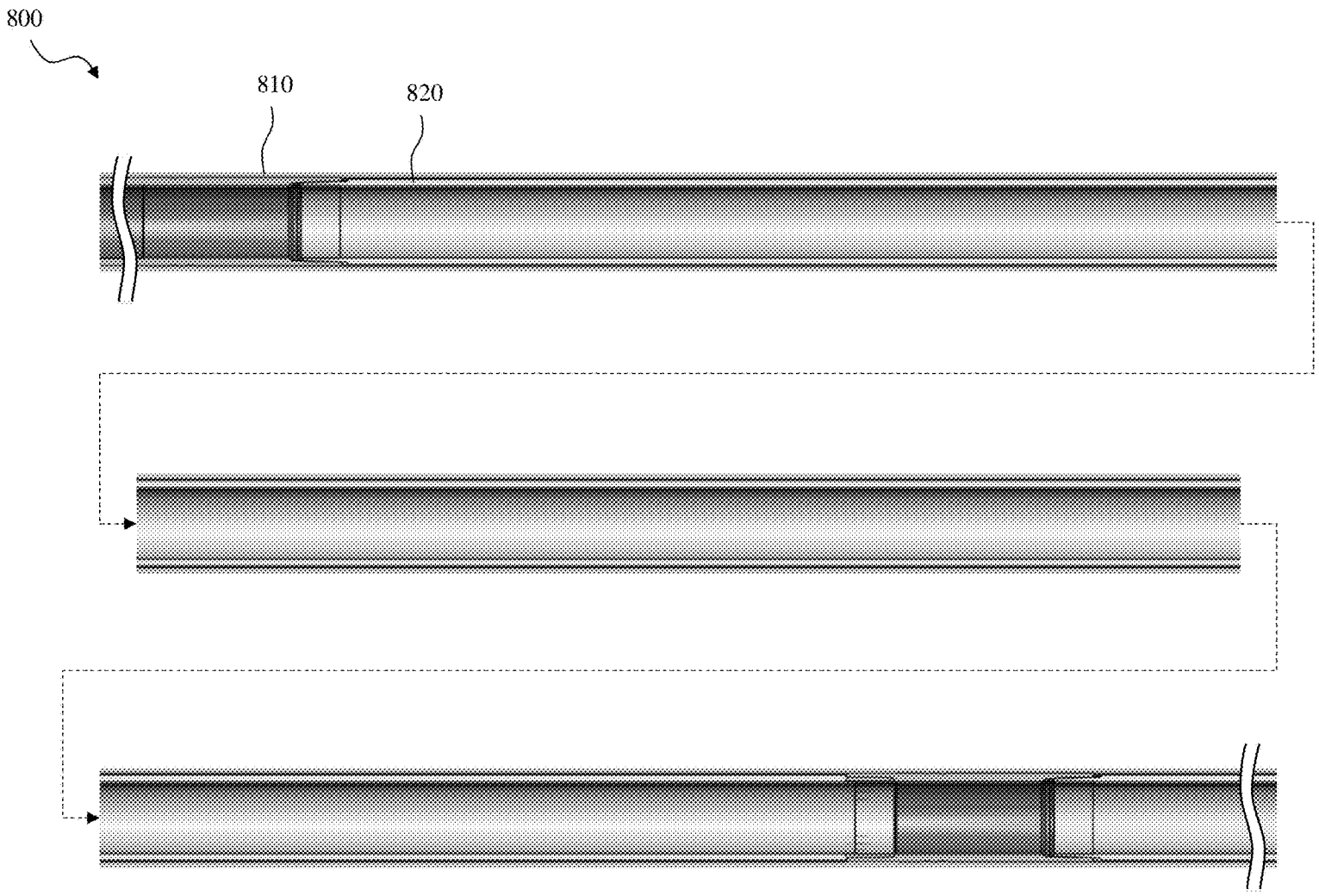
FIGS. 8 through 19 illustrate various different views of a well system, the well system employing a two part drilling and running tool, for example to form a lateral wellbore therein

With initial reference to FIG. 8, the well system 800 initially includes a main wellbore 810. As indicated above, the main wellbore 810 may be a primary wellbore extending from the surface, or a secondary wellbore already extending from a primary wellbore. Located in the main wellbore 810 is tubing string 820, such as casing string. In certain embodiment, while not shown, cement may be positioned between the main wellbore 810 and the tubing string 820.

Figure 9A:
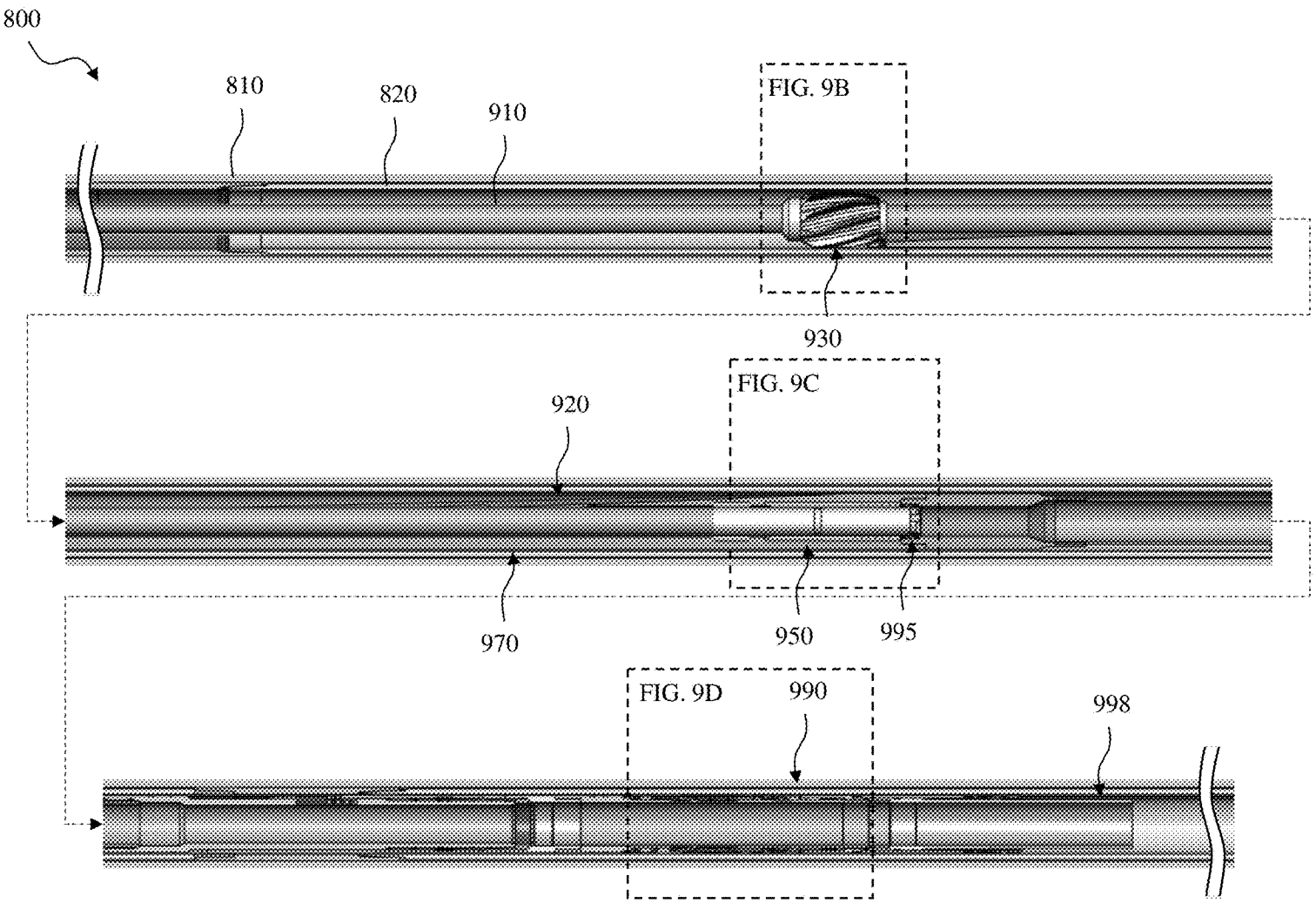

Turning now to FIG. 9A, illustrated is the well system 800 of FIG. 8 after employing a conveyance 910 and a two part drilling and running tool 920 to run a whipstock assembly 970 within the main wellbore 810. In at least one embodiment, the whipstock assembly 970 is coupled to an anchoring assembly 990 and a seal assembly 995 (e.g., smaller bit assembly sealing assembly), and thus the two part drilling and running tool 920 also runs the anchoring assembly 990 and the seal assembly 995 within the wellbore. In at least one embodiment, fluid supplied through the conveyance 910 and through the whipstock assembly 970 acts upon the anchoring assembly 990 to move it from a first collapsed state to a second activated state, and thus secure the whipstock assembly 970 within the main wellbore 810.

In yet another embodiment, a wellbore liner 998 is coupled to a downhole end of the anchoring assembly 990, and thus may also be run in the wellbore 810 with the two part drilling and running tool 920. The wellbore liner 998, in at least one embodiment, might be a lower mainbore completion assembly that might include one or more screens, one or more control valves, etc.

The two part drilling and running tool 920 may be similar to the two part drilling and running tool discussed above. Accordingly, the two part drilling and running tool 920 may include a larger bit assembly 930 and a smaller assembly 950. As shown in the embodiment of FIG. 9A, the smaller assembly 950 is coupled to a downhole end of the conveyance 910, and extends at least partially within a through bore of the whipstock assembly 970.

Figure 9B:
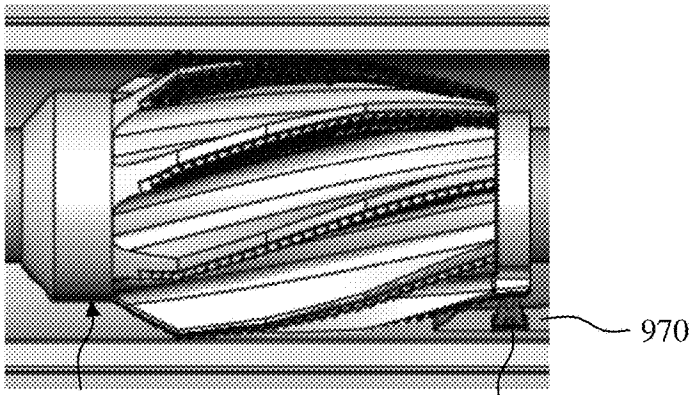

Turning now to FIG. 9B, illustrated is an enlarged side view of the larger bit assembly 930 of FIG. 9A. In the illustrated embodiment of FIG. 9B, the larger bit assembly 930 is coupled proximate an uphole end of the whipstock assembly 970. For example, a coupling mechanism 935 (e.g., shear feature) may be employed to couple the larger bit assembly 930 to the whipstock assembly 970. While a shear feature has been illustrated, other coupling mechanisms 935 could also be used. Moreover, as has been discussed above, the coupling mechanism 935 is not necessary in all embodiments.

Figure 9C:
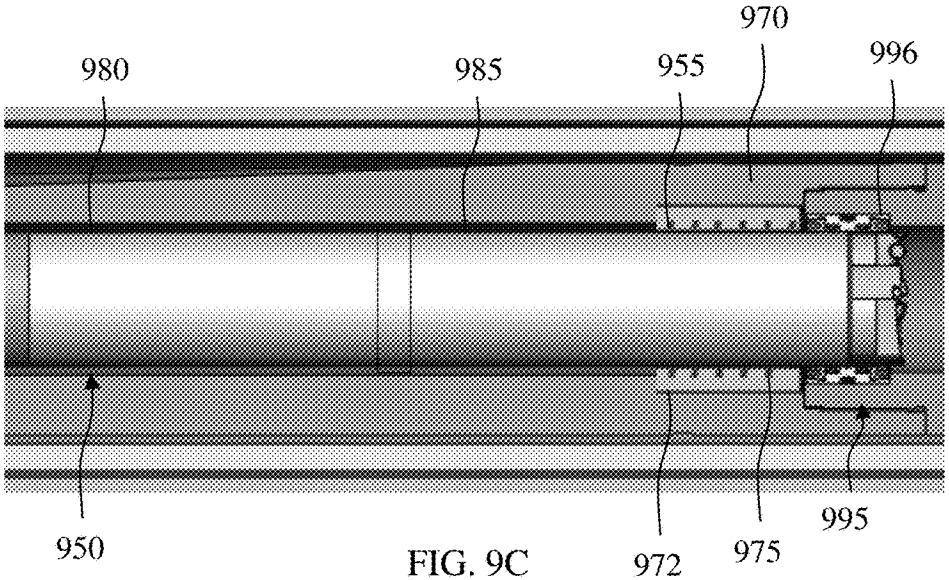

Turning now to FIG. 9C, illustrated is an enlarged side view of the smaller assembly 950 and seal assembly 995 of FIG. 9A. In the illustrated embodiment of FIG. 9C, the smaller assembly 950 is coupled proximate a downhole end of the whipstock assembly 970. For example, a collection of threads 955 have been employed to couple the smaller assembly 950 to the whipstock assembly 970. In one or more embodiments, a coupling mechanism (e.g., shear feature) may exist between the smaller assembly 950 and the whipstock assembly 970, for example to ensure that the running of the whipstock assembly 970, anchoring assembly 990 and liner assembly 998 resists any rotation that would decouple the smaller assembly 950 from the whipstock assembly 970.

In at least one embodiment, the collection of threads 955 is coupled within a bottom 40 percent of the whipstock assembly 970. In yet another embodiment, the collection of threads 955 is coupled within a bottom 20 percent of the whipstock assembly 970. In even another embodiment, the collection of threads 955 is coupled within a bottom 10 percent, if not bottom 5 percent, of the whipstock assembly 970. The smaller assembly 950, in the illustrated embodiment, additionally extends within a through bore 980 of the whipstock assembly 970.

As indicated above, the whipstock assembly 970 may have its own collection of threads 975 that engage with the collection of threads 955 of the smaller assembly 950. In at least one embodiment, the whipstock assembly 970 includes a bushing 972 including the collection of threads 975. Again, as discussed above, the collection of threads 955, 975 may be left hand threads in one embodiment, but may be right hand threads in another embodiment.

As further shown, the seal assembly 995 includes one or more seals 996 configured to provide a seal between itself and the smaller assembly 950. In the illustrated embodiment of FIG. 9C, the one or more seals 996 are located in the seal assembly 995 itself, and thus seal against a polished bore surface of the smaller assembly 950 to provide a fluid tight seal. In other embodiments, however, the one or more seals 996 could be located on the smaller assembly 950, and thus seal against a polished bore surface of the seal assembly 995. Those skilled in the art understand the various different seals that might be used and remain within the scope of the present disclosure.

Figure 9D:
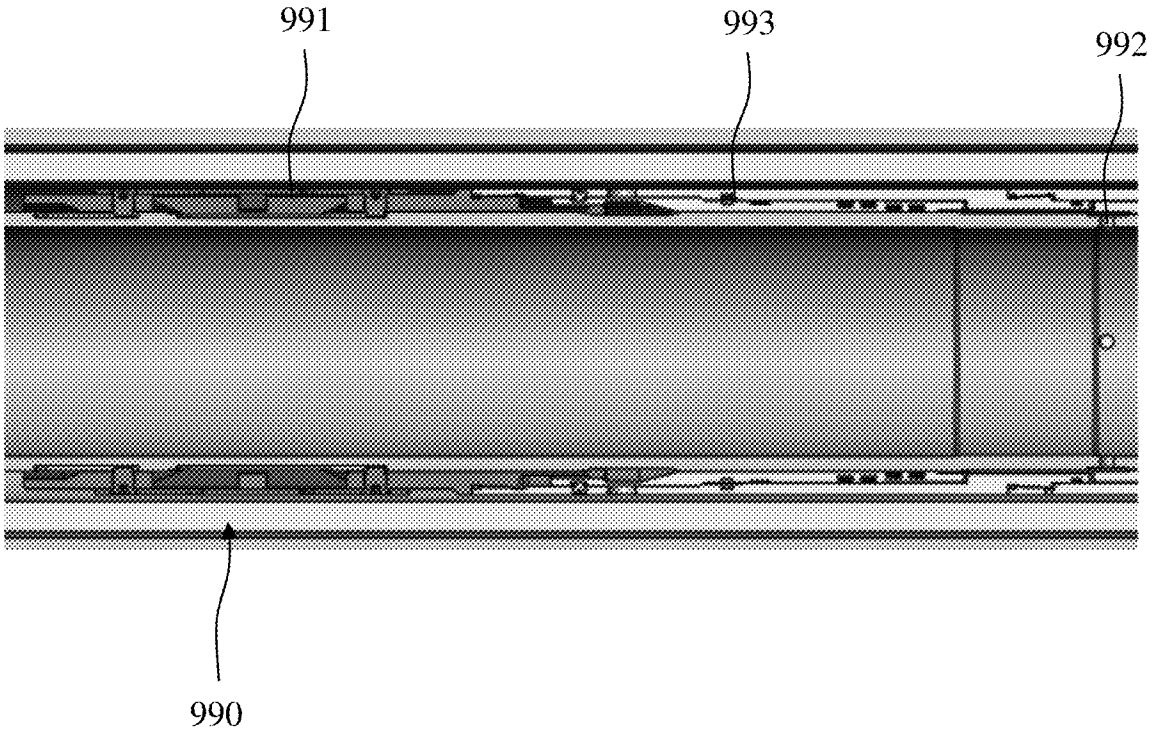

Turning now to FIG. 9D, illustrated is an enlarged side view of the anchoring assembly 990. In the illustrated embodiment, the anchoring assembly is a hydraulically actuated anchoring assembly. For example, the anchoring assembly 990 of FIG. 9D employs one or more hydraulically actuated slips 991 that may move from the first collapsed state to the second activated state to engage with the main wellbore. In at least one embodiment, the fluid would enter through fluid inlet 992 and act upon slip piston 993 to move the one or more hydraulically actuated slips 991 from the first collapsed state to the second activated state. While the anchoring assembly 990 employs the one or more hydraulically actuated slips 991 in the embodiment of FIG. 9D, in at least one other embodiment a mechanical anchoring assembly similar could be used.

Figure 10A:
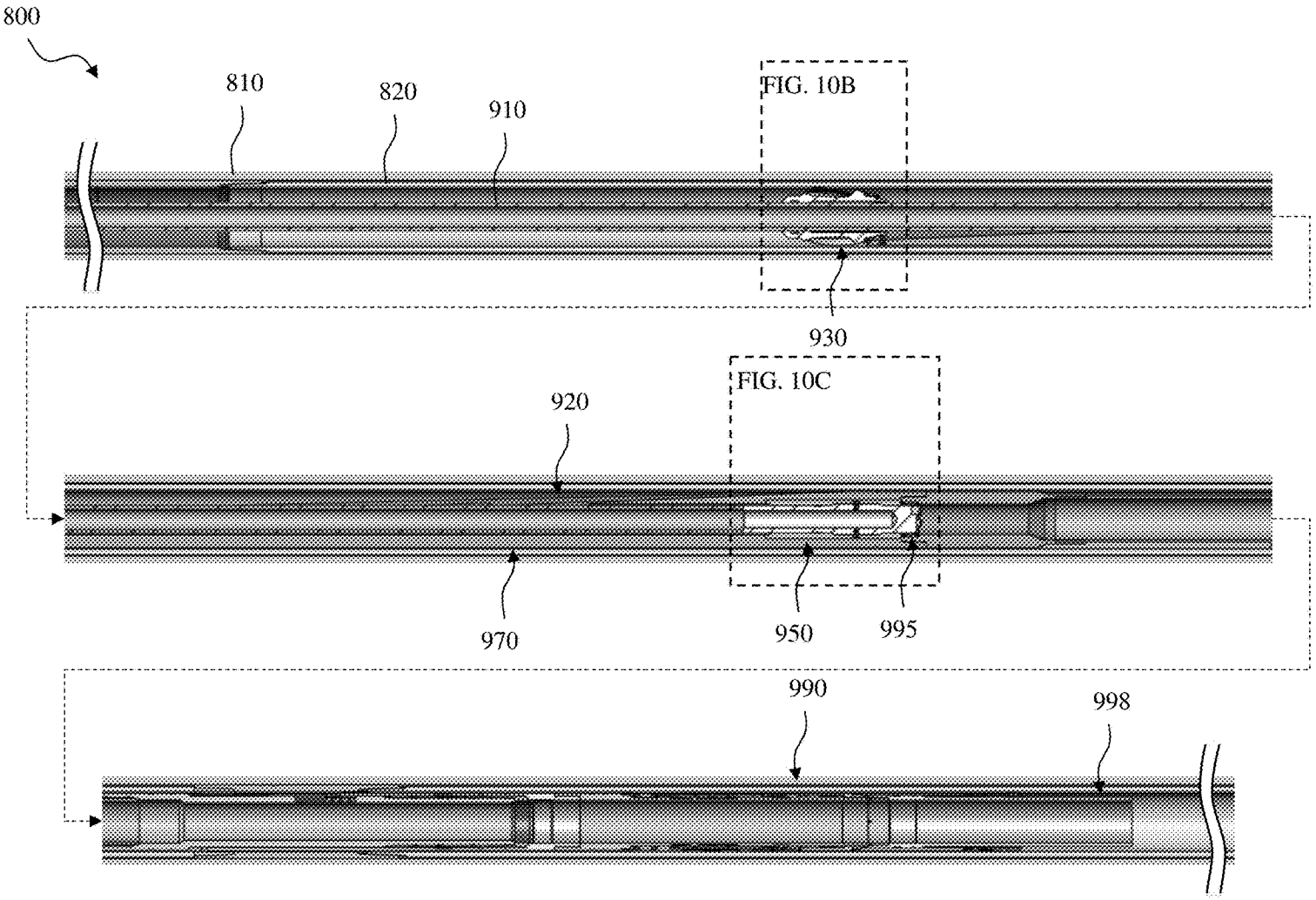

Turning to FIG. 10A, illustrated is a cross-sectional side view of the well system 800 of FIG. 9A.

Figure 10C:
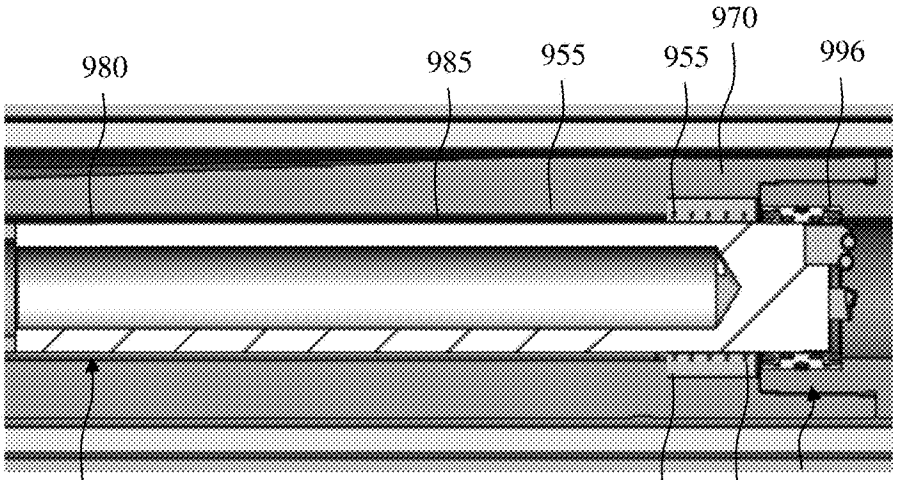
Figure 10B:
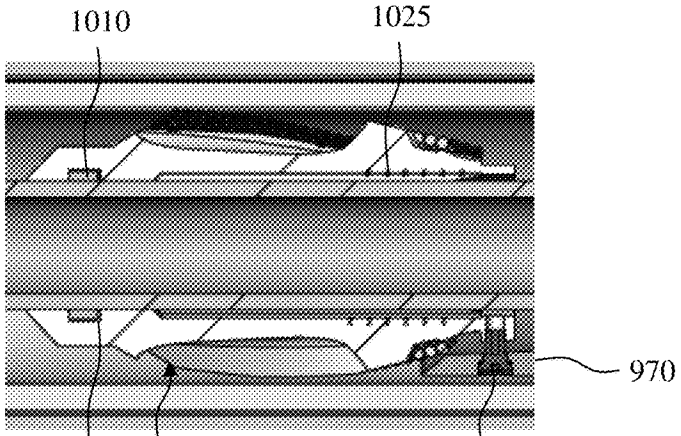

Turning now to FIG. 10B, illustrated is an enlarged cross-sectional side view of the larger bit assembly 930 of FIG. 10A. As can be seen in FIG. 10B, a lock ring 1010 may be positioned within a lock ring profile 1020 in the larger bit assembly 930. As the conveyance 910 does not have a corresponding lock ring profile in the embodiment shown, but for the coupling mechanism 935, the larger bit assembly 930 would be allowed to slide along the conveyance 910 freely. Nevertheless, the coupling mechanism 935 is preventing the larger bit assembly 930 from moving in the embodiment of FIG. 10B.

The larger bit assembly 930, in at least this one embodiment, additionally includes a collection of threads 1025, for example, that could engage with the collection of threads 955 of the smaller assembly 950. In the illustrated embodiment, the collection of threads 1025 are left hand threads, such that as the smaller assembly 950 approaches the larger bit assembly 930 right hand twisting of the smaller assembly 950 will cause the smaller assembly 950 to engage and remain engaged with the larger bit assembly 930.

Turning now to FIG. 10C, illustrated is an enlarged cross-sectional side view of the smaller assembly 950 of FIG. 10A.

Figure 11A:
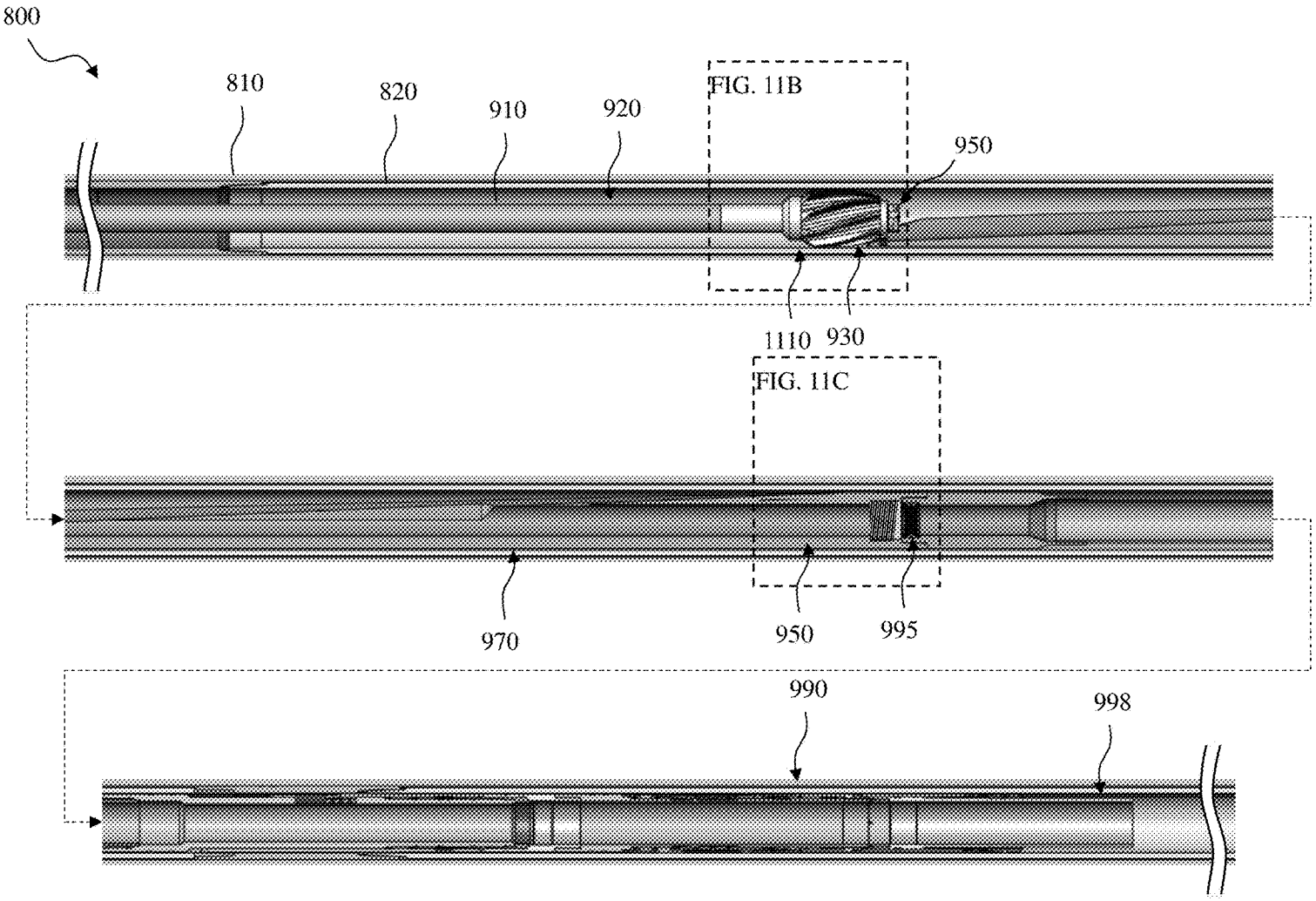

Turning now to FIG. 11A, illustrated is the well system 800 of FIG. 10A rotating the smaller assembly 950 in the appropriate direction (e.g., right hand twisting in the illustrated embodiment) such that the smaller assembly 950 disengages from the whipstock assembly 970. In the illustrated embodiment, with the smaller assembly 950 disengaged from the whipstock assembly 970, the smaller assembly 950 has subsequently been withdrawn uphole. Given the sliding relationship between the smaller assembly 950 and the larger bit assembly 930, and the fact that the larger bit assembly 930 is fixed relative to the whipstock assembly 970, the conveyance 910 slides within an inside diameter of the larger bit assembly 930. As shown, the conveyance 910 has been pulled uphole, thereby sliding the smaller assembly 950 into engagement with the larger bit assembly 930, and thus forming a combined bit assembly 1110, for example using the above discussed collection of threads. In yet another embodiment, not shown, a collection of spines and slots may be employed to rotationally fix the smaller assembly 950 and the larger bit assembly 930 together, whereas the snap ring can axially fix the two together.

Figure 11B:
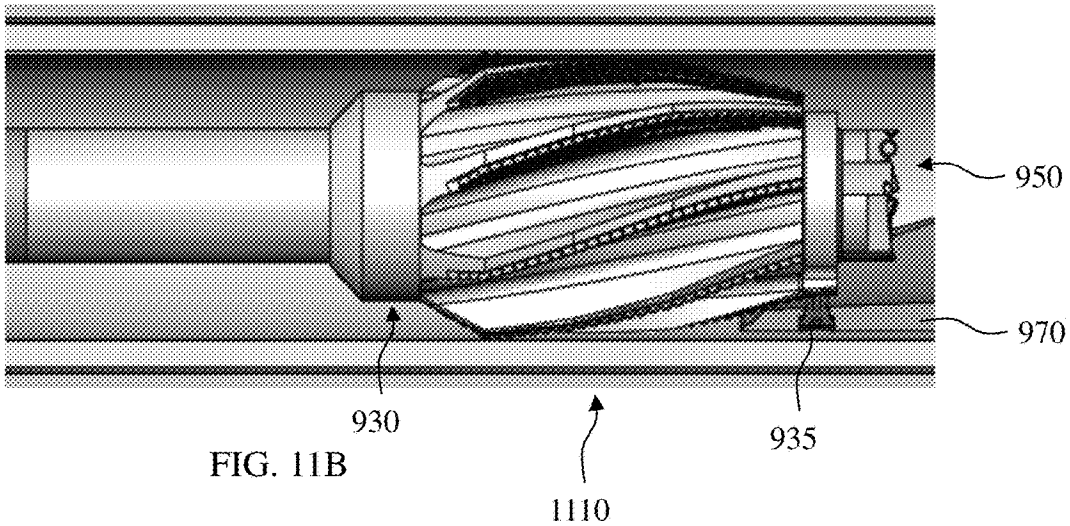

Turning now to FIG. 11B, illustrated is an enlarged side view of the combined bit assembly 1110 of FIG. 11. As shown, the smaller assembly 950 is engaged with the larger bit assembly 930. Furthermore, with the smaller assembly 950 engaged with the larger bit assembly 930, the combined bit assembly 1110 may now approximate the shape of bit assemblies currently existing in the art.

Figure 11C:
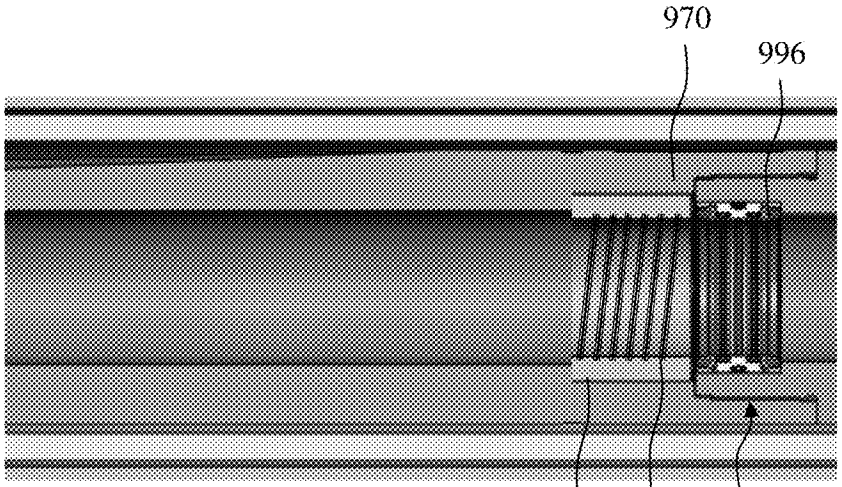

Turning now to FIG. 11C, illustrated is an enlarged side view of the whipstock assembly 970. As shown, the whipstock assembly 970 has the collection of threads 975 that were previously engaged with the collection of threads 955 of the smaller assembly 950.

Figure 12A:
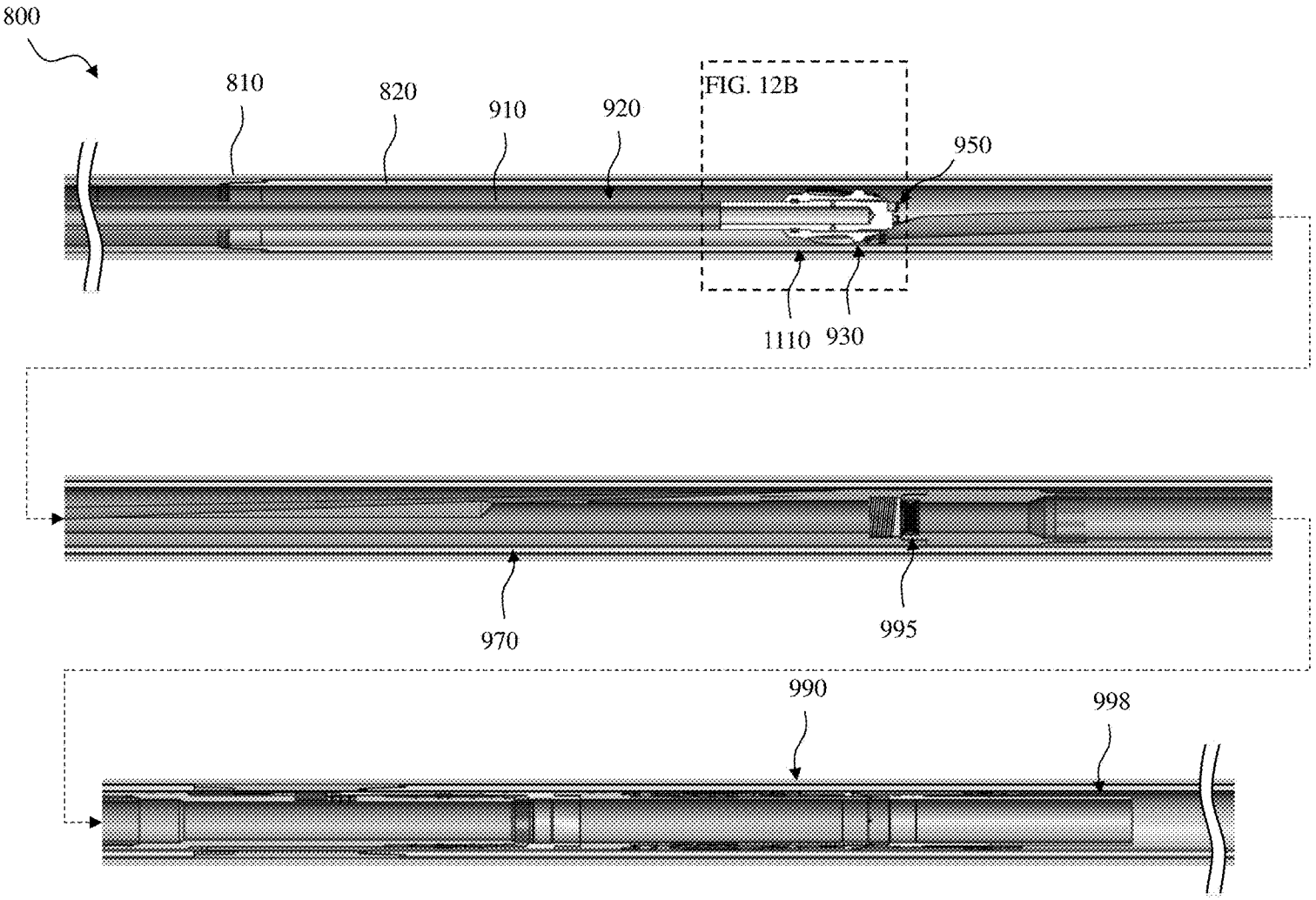

Turning to FIG. 12A, illustrated is a cross-sectional side view of the well system 800 of FIG. 11A.

Figure 12B:
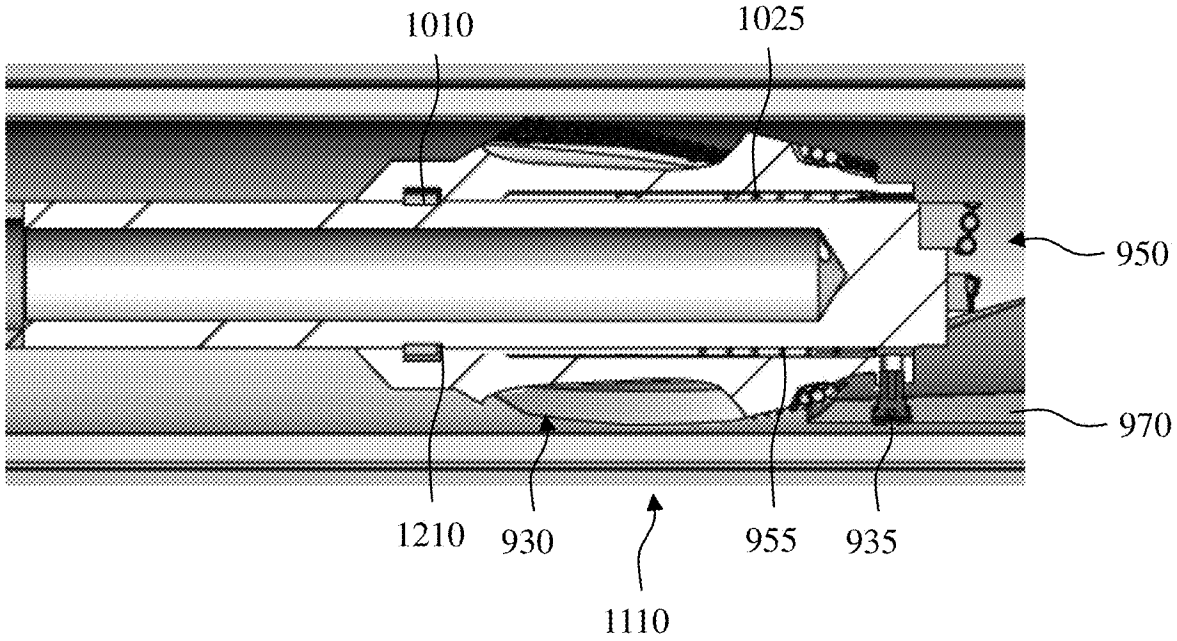

Turning now to FIG. 12B, illustrated is an enlarged cross-sectional side view of the combined bit assembly 1110 of FIG. 12A. As shown in FIG. 12B, the lock ring 1010 may snap into the associated lock ring profile 1210 in the smaller assembly 950, and thus axially fix the smaller assembly 950 relative to the larger bit assembly 930. As discussed above, the collection of threads 955 in the smaller assembly 950 may engage with the collection of threads 1025 of the larger bit assembly 930 to rotationally and/or axially fix the smaller assembly 950 relative to the larger bit assembly 930.

Figure 13A:
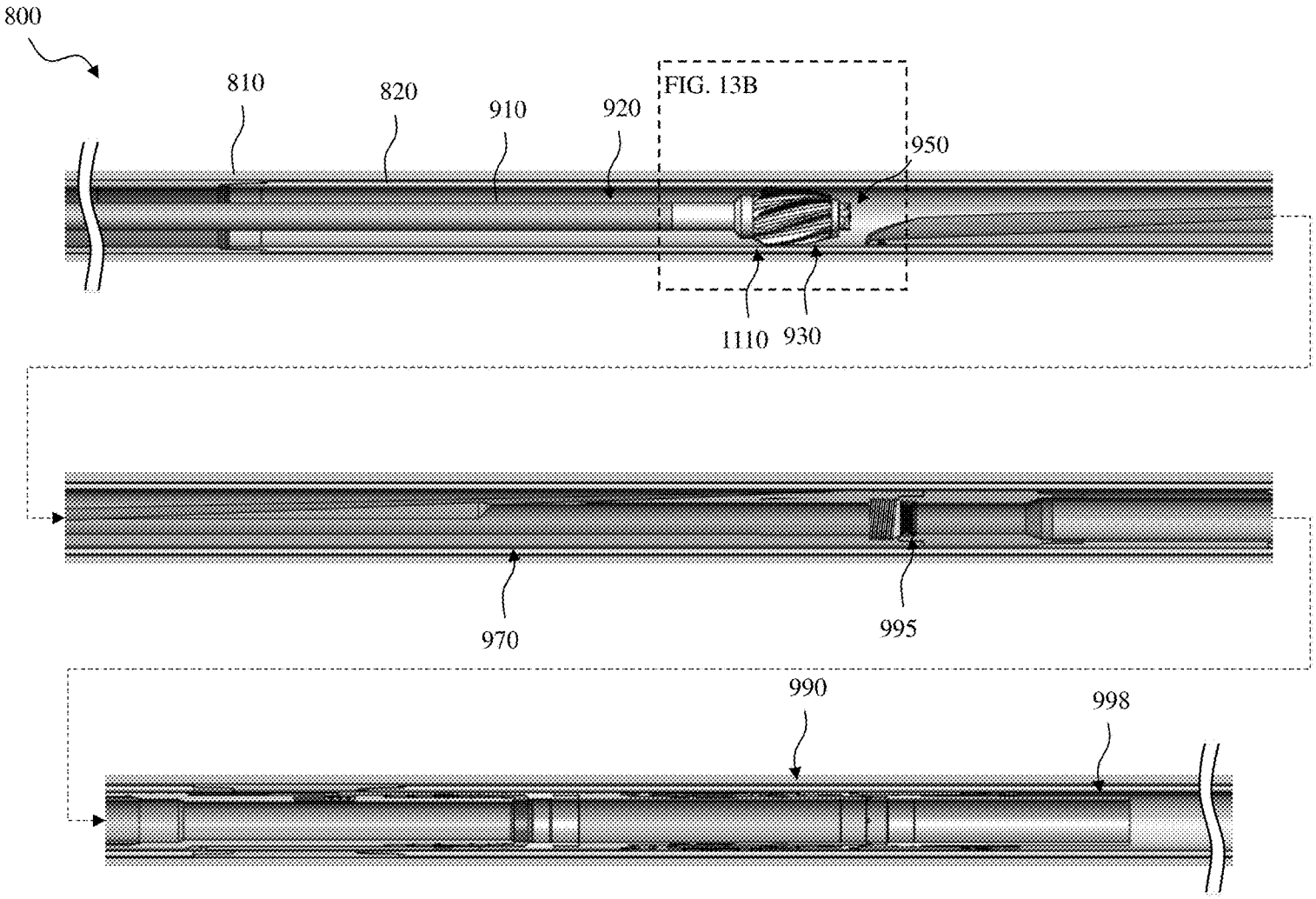

Turning to FIG. 13A, illustrated is a side view of a well system 800 of FIG. 12A, after the coupling mechanism 935 has sheared and the conveyance 910 has been pulled further uphole. In at least one embodiment, any one of a compressive force, tensile force or torsional force may shear the coupling mechanism 935. Accordingly, at this stage, the combined bit assembly 1110 is no longer axially or rotationally fixed to the whipstock assembly 970, but the whipstock assembly remains fixed within the wellbore.

Figure 13B:
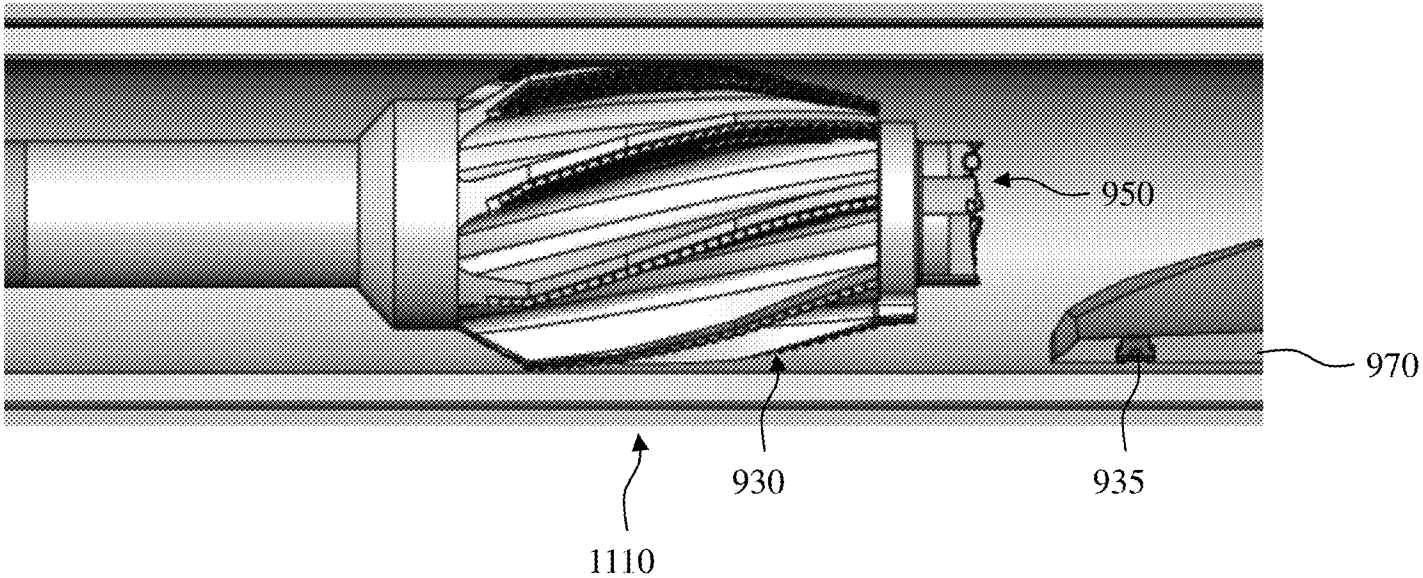

Turning now to FIG. 13B, illustrated is an enlarged side view of the combined bit assembly 1110 of FIG. 13A after it is no longer coupled to the whipstock assembly 970.

Figure 14A:
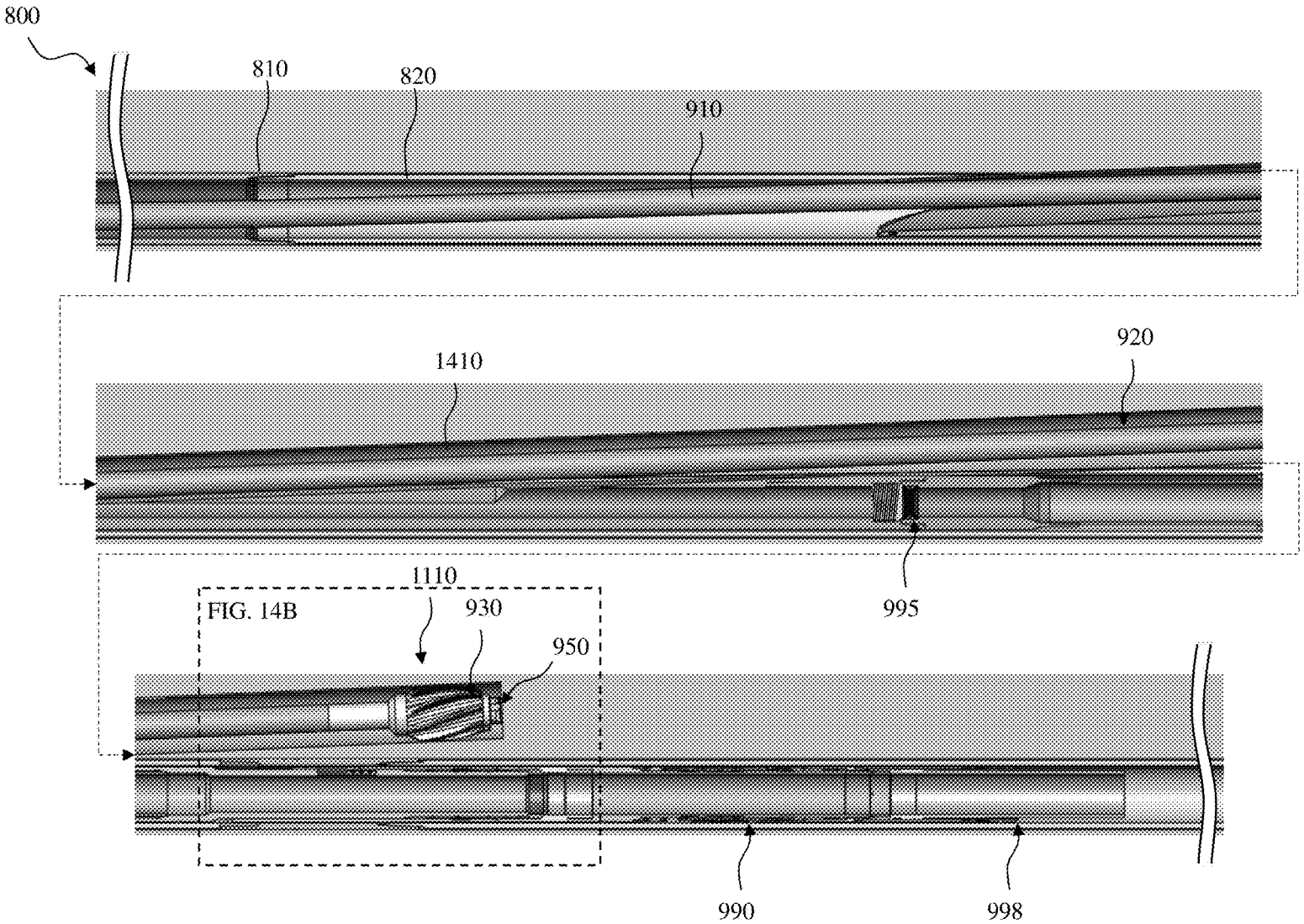

Turning to FIG. 14A, illustrated is a side view of a well system 800 of FIG. 13A, after the conveyance 910 and combined bit assembly 1110 are being pushed back downhole to mill at least a portion of the tubing string 820 to form an exit therein. At the stage illustrated in FIG. 14A, the conveyance 910 and combined bit assembly 1110 have finished forming the exit in the tubing string 820 and have formed a lateral wellbore 1410 (e.g., starting with an initial rat hole) in the subterranean formation.

Figure 14B:
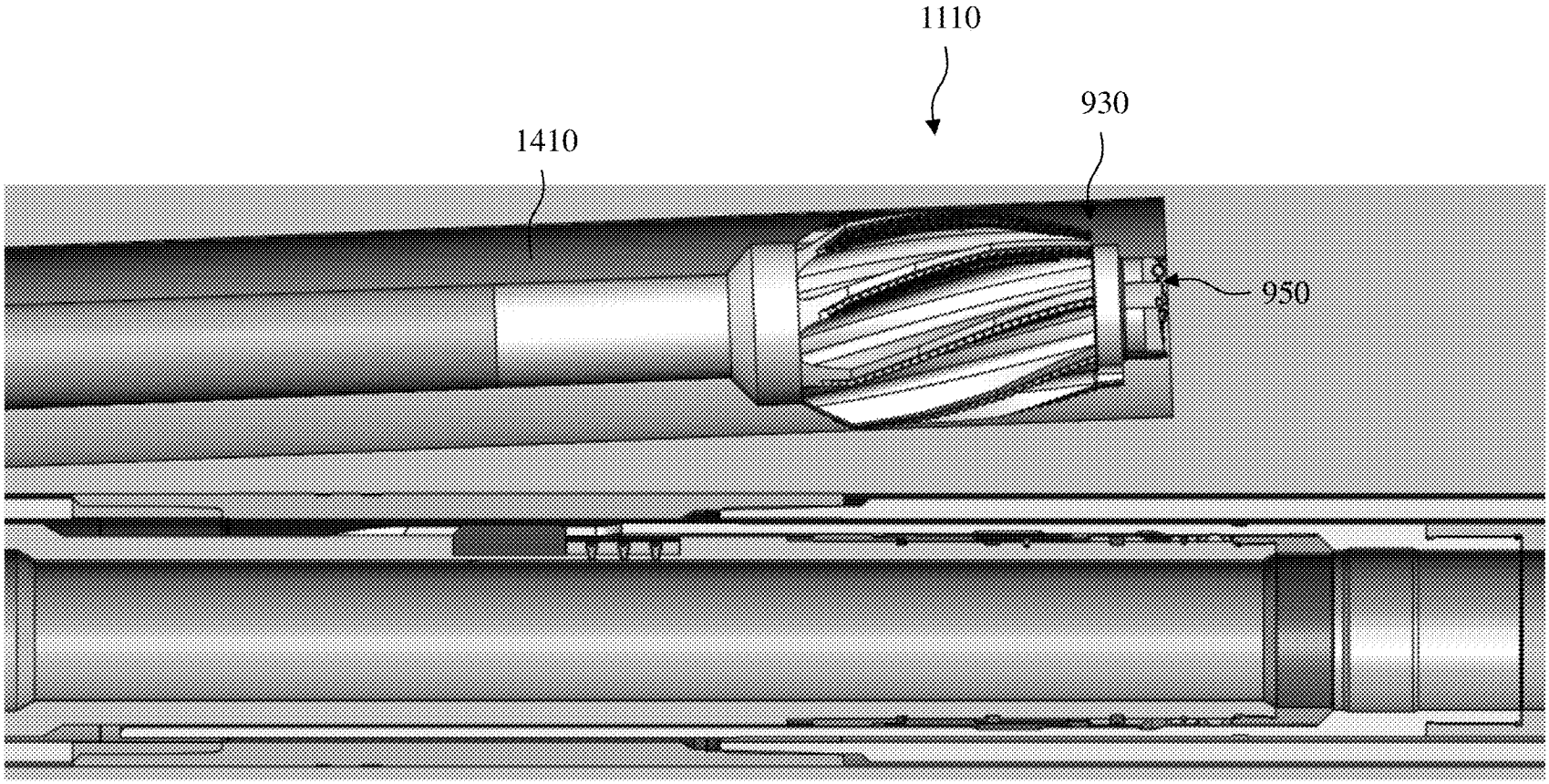

Turning now to FIG. 14B, illustrated is an enlarged side view of the combined bit assembly 1110 of FIG. 14A after forming the lateral wellbore 1410 in the subterranean formation.

Figure 15:
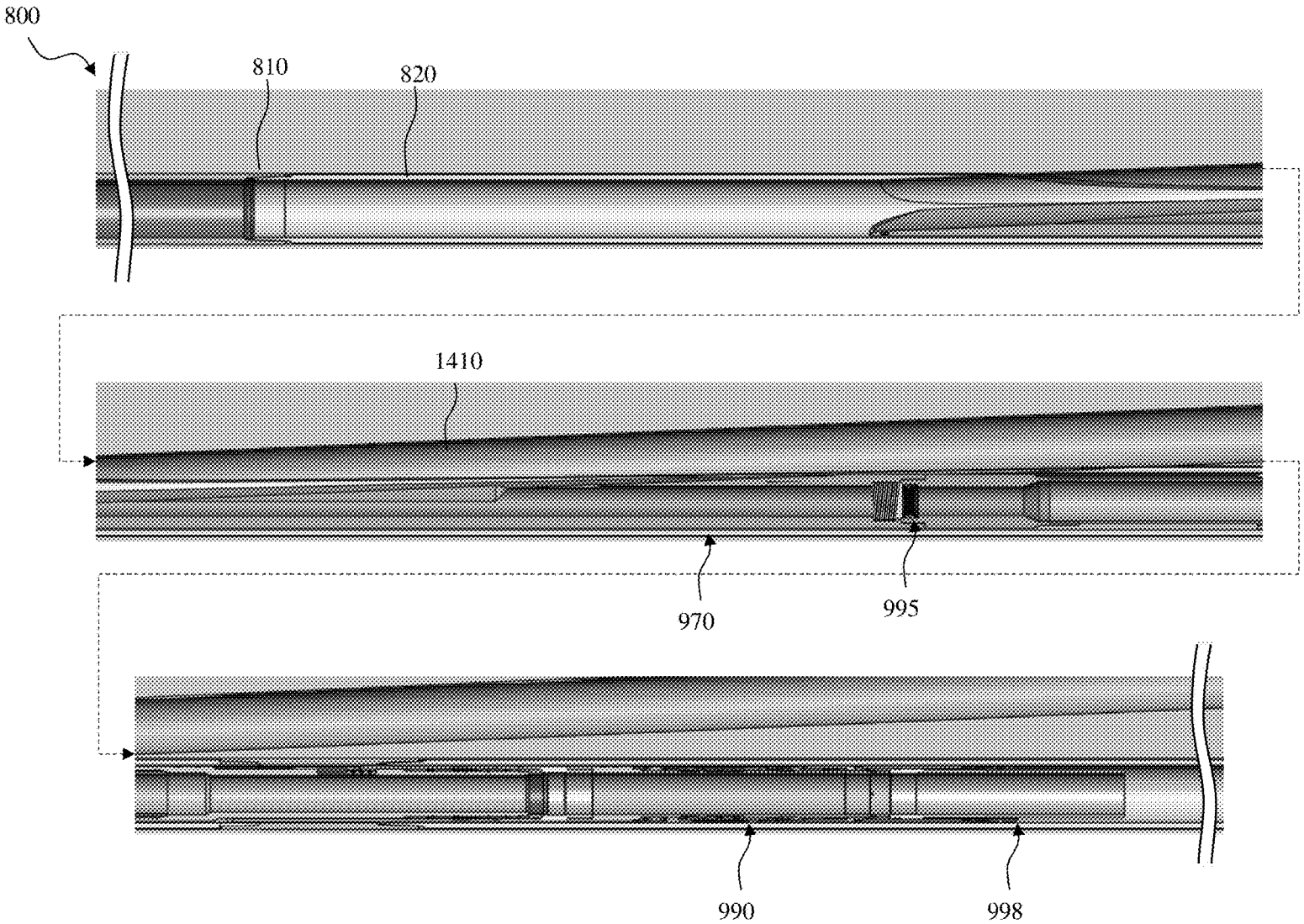

Turning to FIG. 15, illustrated is a side view of a well system 800 of FIG. 14A, after the conveyance 910 and combined bit assembly 1110 have been pulled from the lateral wellbore 1410 and the main wellbore 810.

Figure 16A:
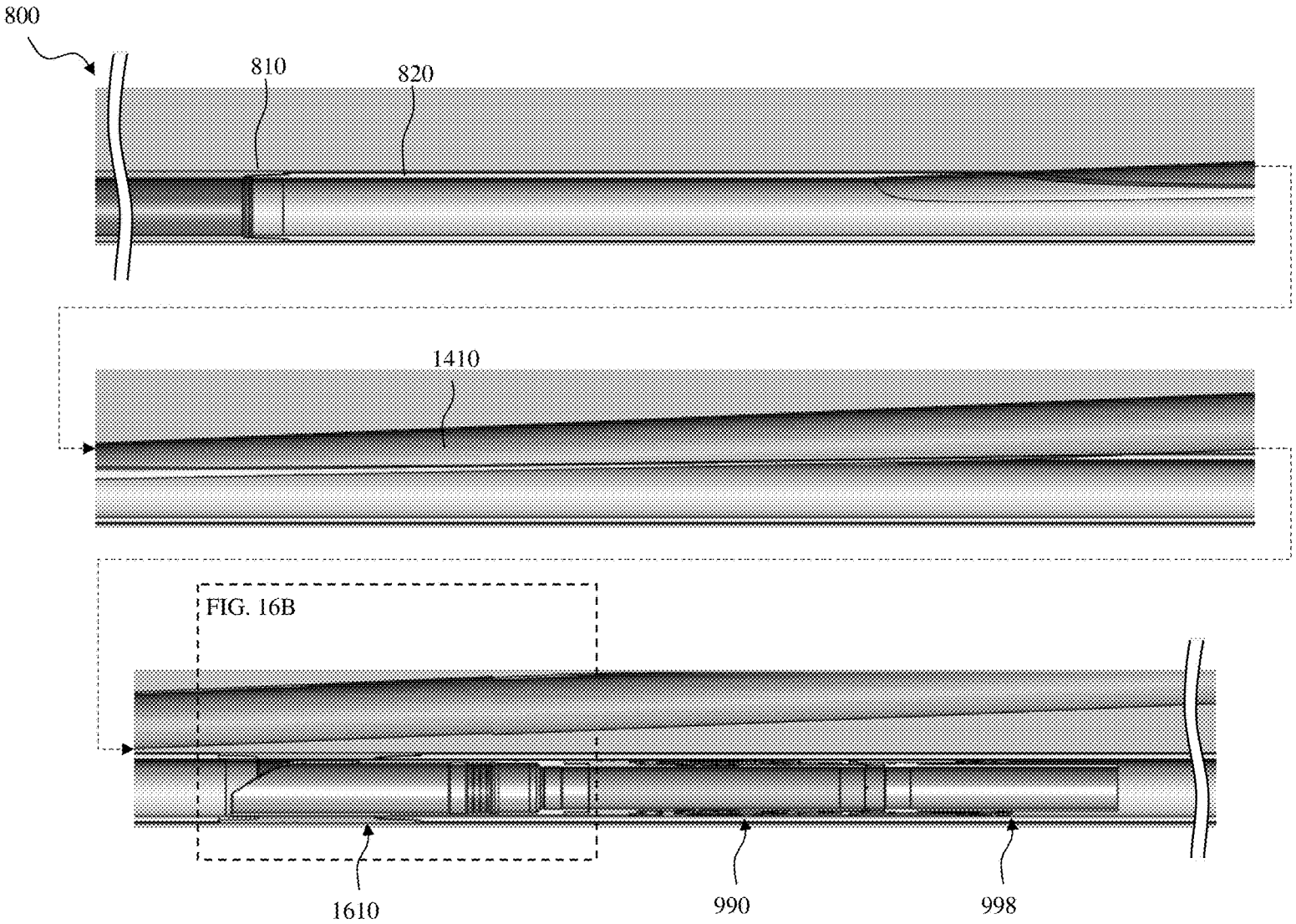

Turning to FIG. 16A, illustrated is a side view of a well system 800 of FIG. 15, after the whipstock assembly 970 has been removed from the main wellbore 810. While the embodiment of FIGS. 15 and 16A illustrates that the removal of the combined bit assembly 1110 and the whipstock assembly 970 are two separate trips, certain embodiments may exist wherein a single trip is employed to remove both the combined bit assembly 1110 and the whipstock assembly 970. What remains is a deflector alignment assembly 1610 (e.g., including a slotted muleshoe in one embodiment).

Figure 16B:
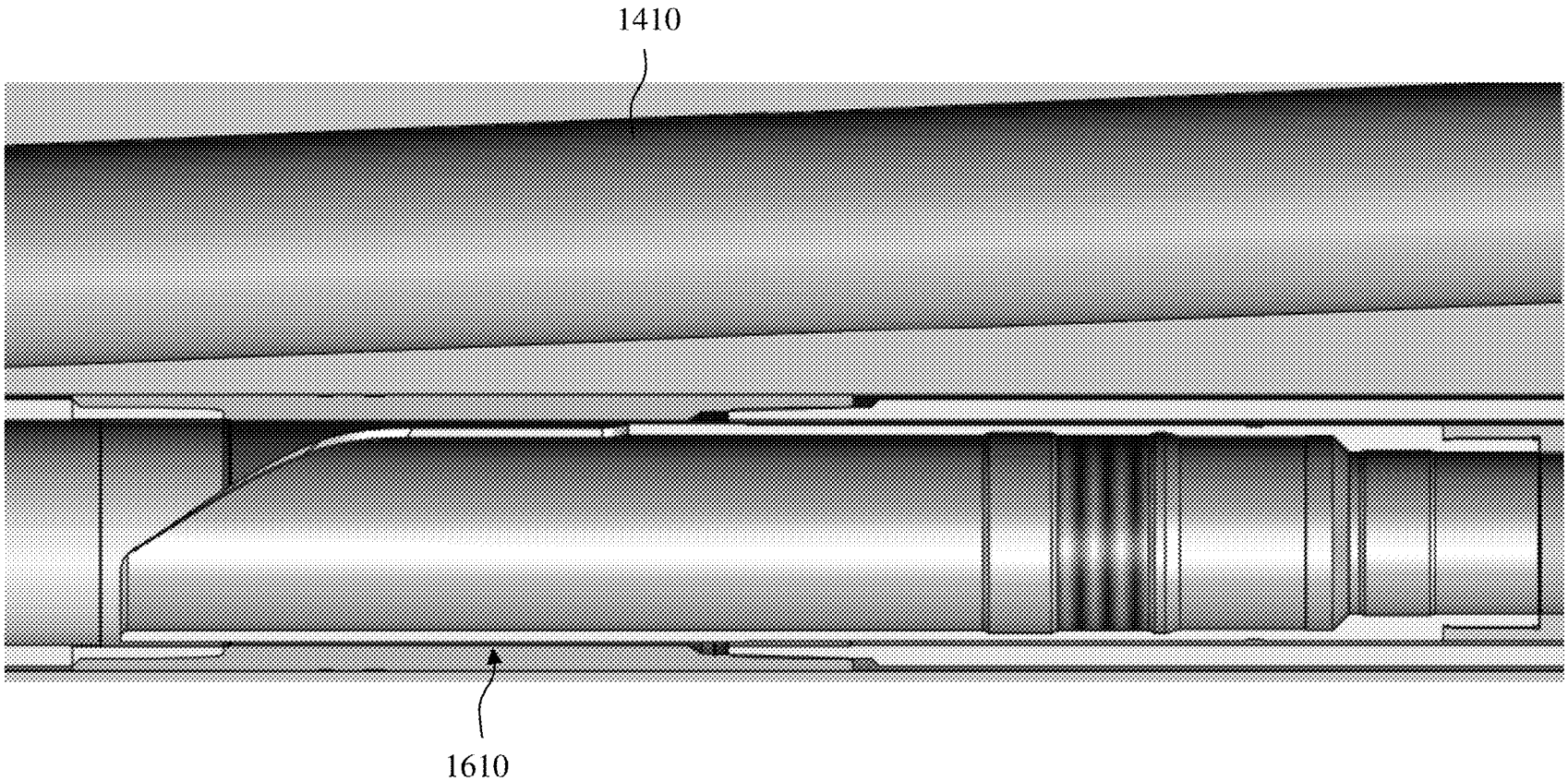

Turning now to FIG. 16B, illustrated is an enlarged side view of the well system 800 of FIG. 16A including the deflector alignment assembly 1610 in the main wellbore 810.

Figure 17A:
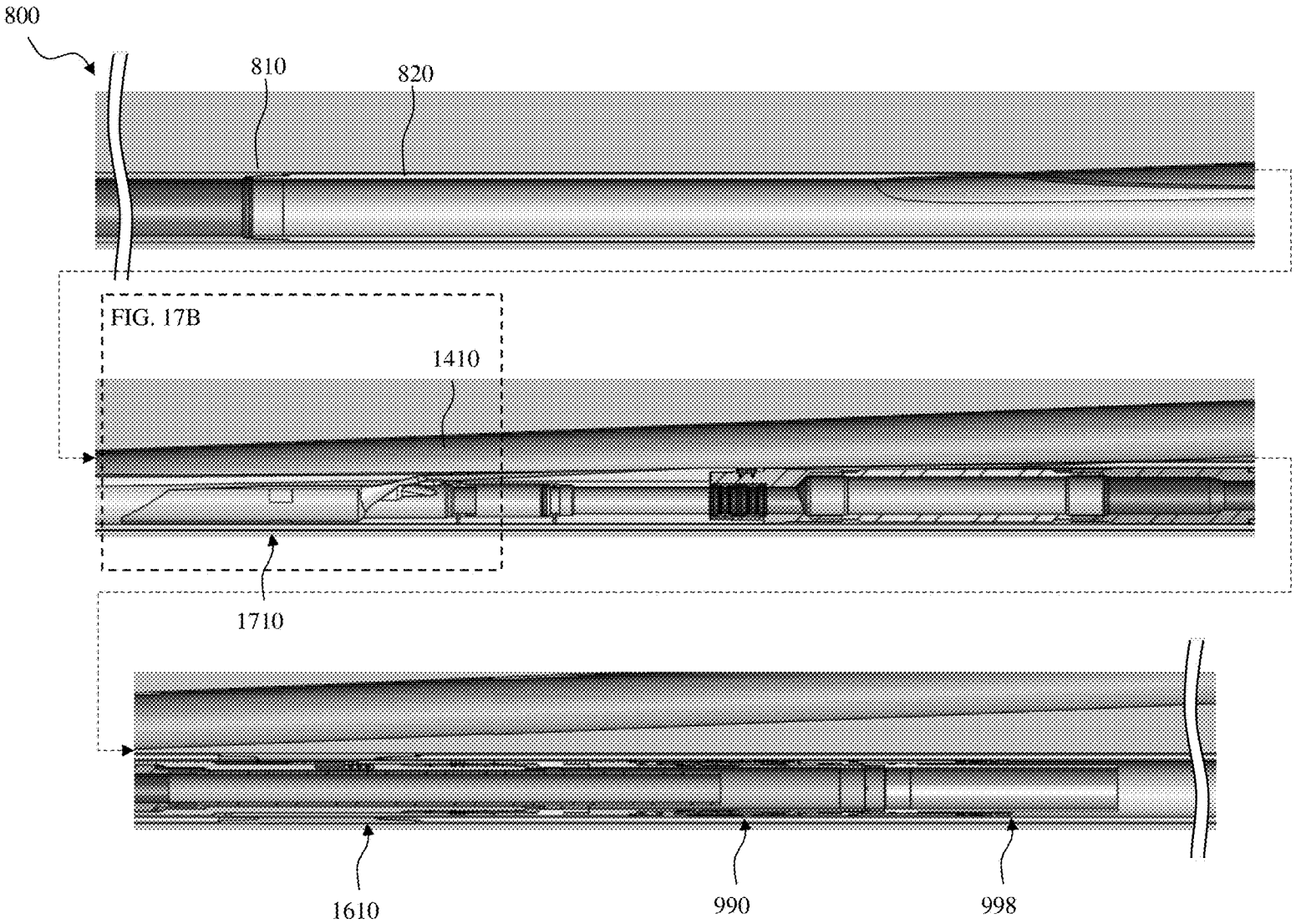

Turning to FIG. 17A, illustrated is a side view of a well system 800 of FIG. 16A, after a deflector assembly 1710 has been positioned within the main wellbore 810 and appropriately located and aligned (e.g., both laterally and rotationally), for example using the deflector alignment assembly 1610.

Figure 17B:
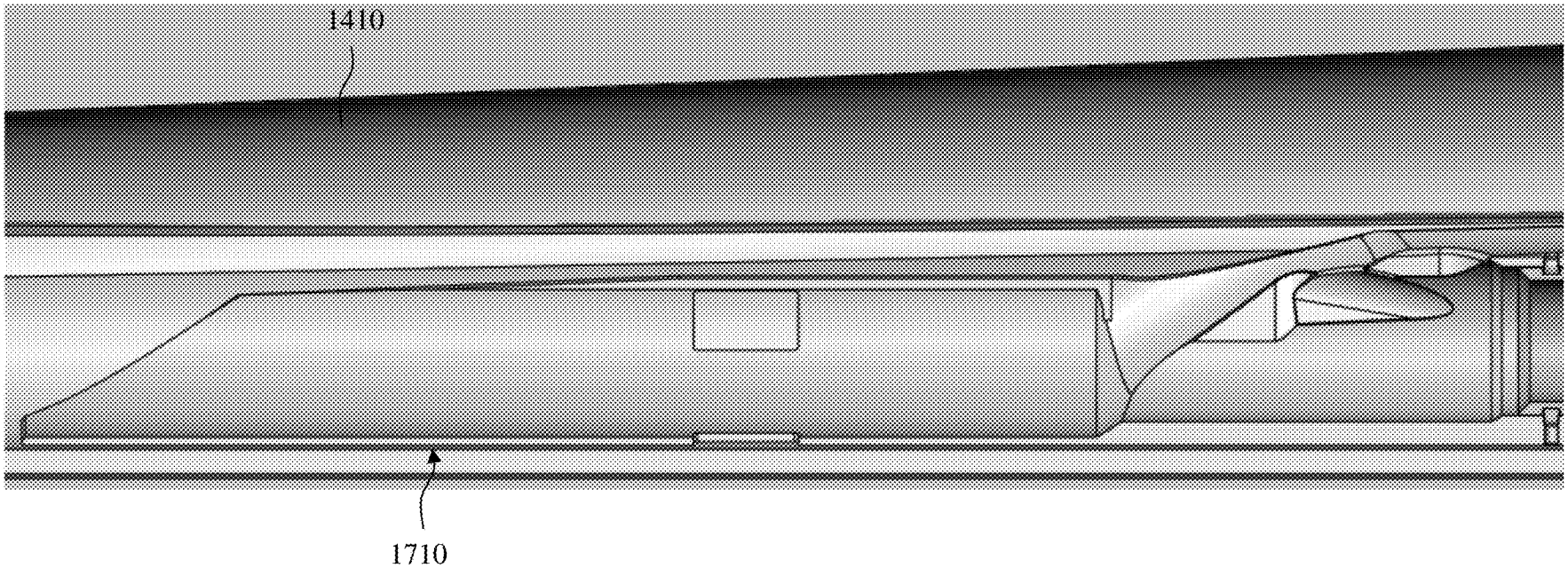

Turning now to FIG. 17B, illustrated is an enlarged side view of the well system 800 of FIG. 17A including the deflector assembly 1710 in the main wellbore 810.

Figure 18:
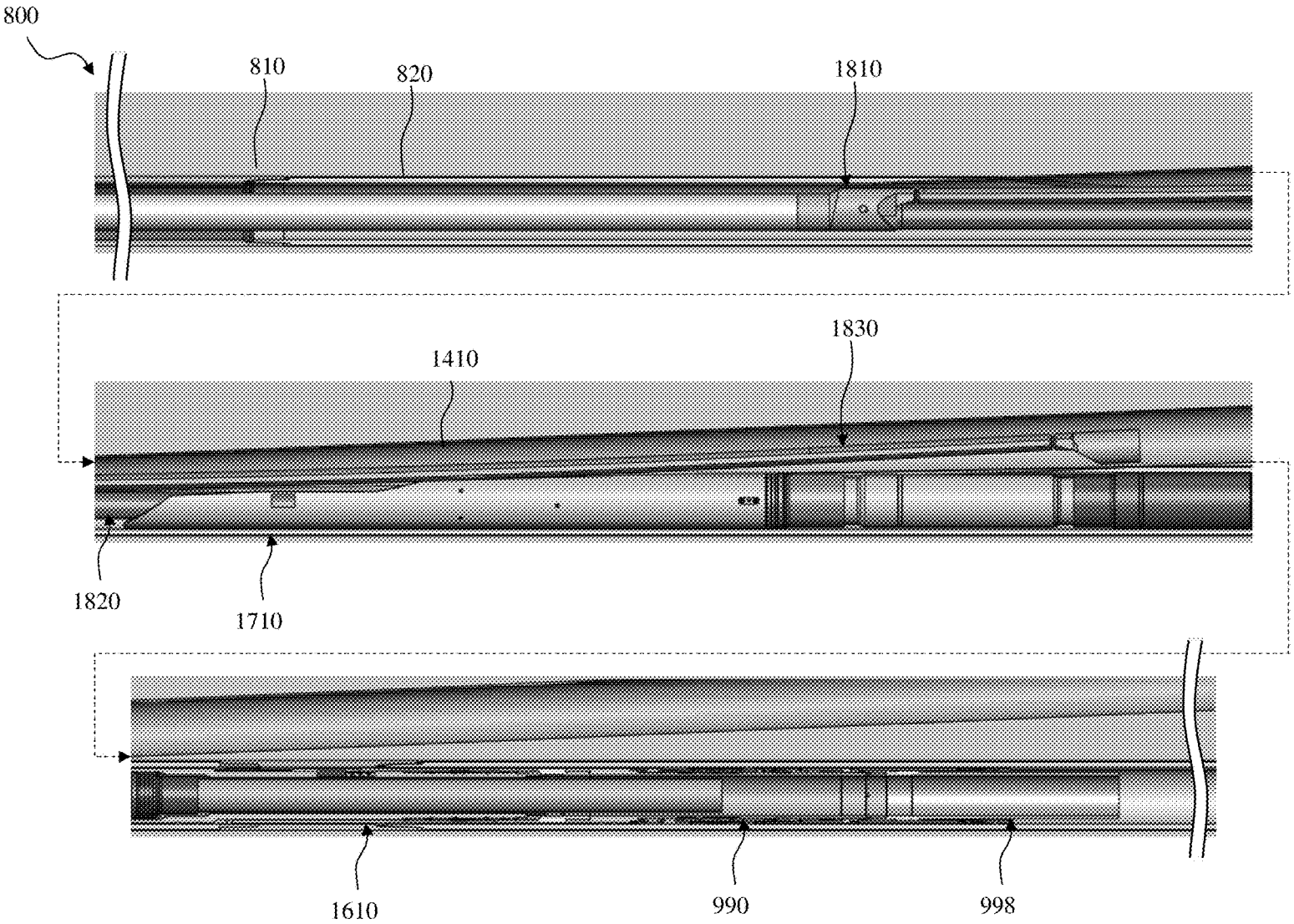

Turning to FIG. 18, illustrated is a side view of a well system 800 of FIG. 17A, after a multilateral junction assembly 1810 has been positioned within the main wellbore 810 and the lateral wellbore 1410. In the illustrated embodiment, the multilateral junction assembly 1810 includes a main bore leg 1820 that remains within the main wellbore 810 and a lateral bore leg 1830 that deflects out of the main wellbore 810 and into the lateral wellbore 1410.

Figure 19:
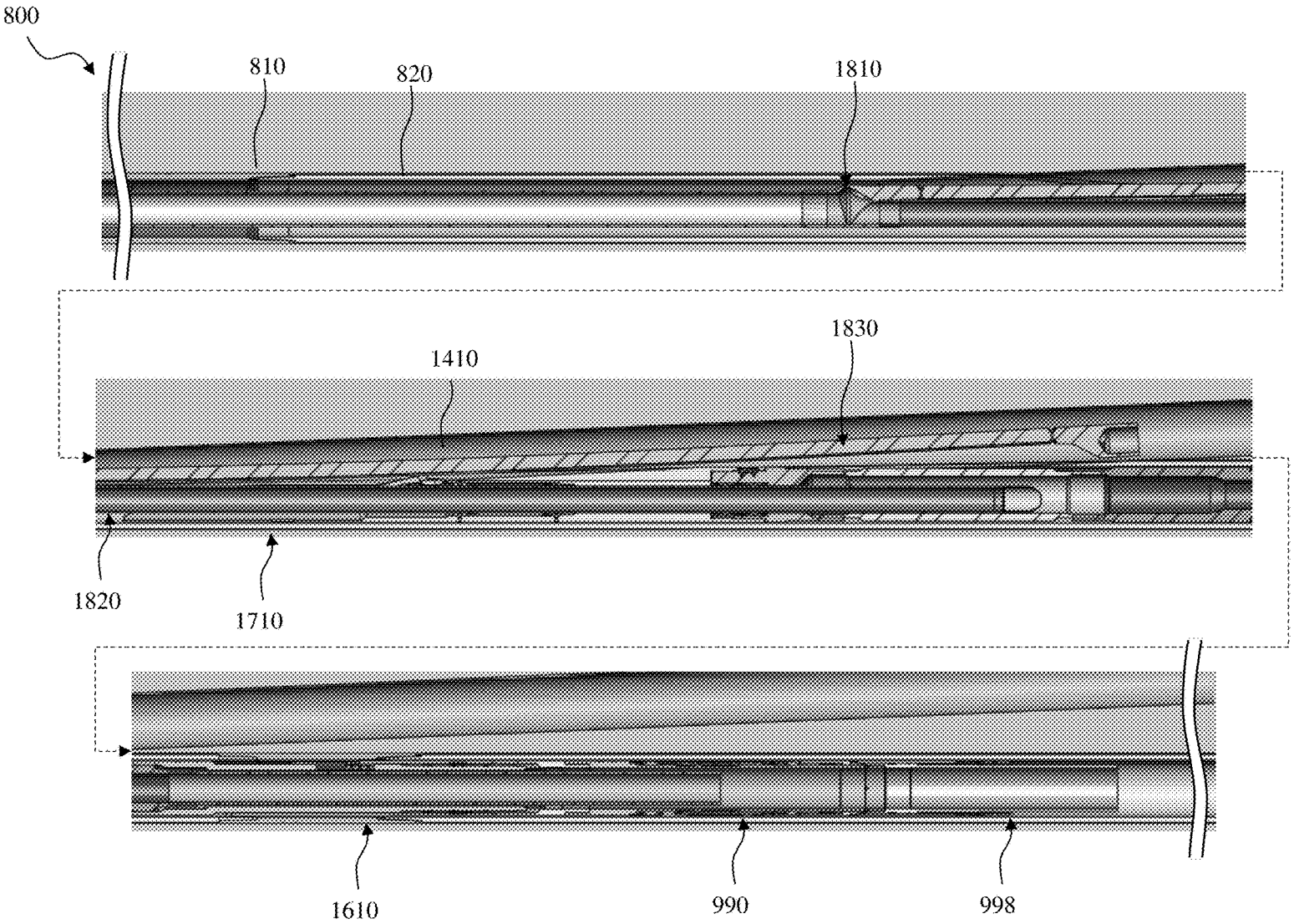

Turning to FIG. 19, illustrated is a cross-sectional side view of the well system 800 of FIG. 18.

Figure 20A:
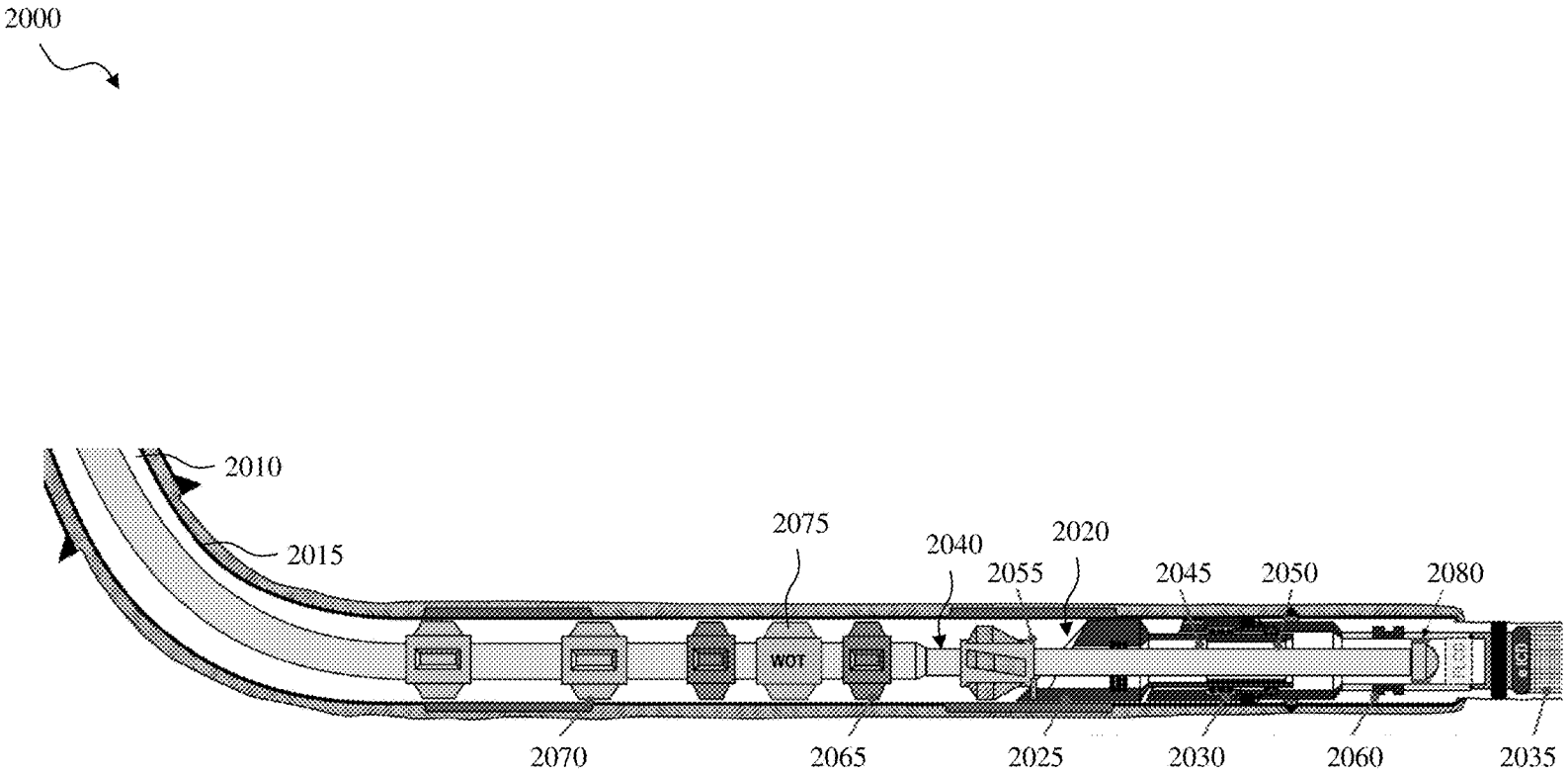
FIGS. 20A and 20B illustrate a well system designed, manufactured and operated according to one embodiment of the disclosure, the well system employing a two part drilling and running tool.

Turning to FIG. 20A, illustrated is a side view of a well system 2000 designed, manufactured and operated according to one or more embodiments of the disclosure. The well system 2000, in one embodiment, includes a wellbore 2010 having wellbore casing 2015 therein. The well system 2000, in the illustrated embodiment, further includes a downhole tool 2020, the downhole tool 2020 including a whipstock assembly 2025, an anchoring assembly 2030 and a wellbore liner 2035 (e.g., a lower completion in one embodiment of the disclosure, including one or more screen assemblies). In at least one embodiment, the downhole tool 2020 including the whipstock assembly 2025, the anchoring assembly 2030 and the wellbore liner 2035 are run in a single trip.

The well system 2000, in accordance with this embodiment, additionally includes a two part drilling and running tool 2040, the two part drilling and running tool including a conveyance 2045, a smaller assembly 2050 and a larger bit assembly 2055. In at least one embodiment, the smaller assembly 2050 is coupled to an end of the conveyance, the smaller assembly 2050 having a collection of threads located proximate a downhole end thereof, the collection of threads configured to help engage and/or disengage from a wellbore tool positioned there below. In at least on embodiment, the larger bit assembly 2055 is slidably coupled to the conveyance 2045, the smaller assembly 2050 and larger bit assembly 2055 configured to slidingly engage one another downhole to form a combined bit assembly (not shown). In the illustrated embodiment, the downhole tool 2020 additionally includes a swivel mechanism 2060 positioned between the anchoring assembly 2030 and the wellbore liner 2035, as well as a stabilizer 2065, a string magnet 2070 and an orientation tool 2075 (e.g., workstring orientation tool (WOT)).

Further to the embodiment of FIG. 20A, the smaller assembly 2050 is coupled to the wellbore liner 2035 using the aforementioned collection of threads. In the illustrated embodiment, the smaller assembly 2050 is coupled to the wellbore liner 2035 downhole of a swivel mechanism 2080. In at least this one embodiment, the two part drilling and running tool 2040, in part due to the smaller assembly 2050 being coupled downhole of the swivel mechanism 2060, may rotate the liner assembly 2035 as the downhole tool 2020 is being run in hole, and prior to the anchoring assembly 2030 being set.

In operation, the downhole tool 2020 (e.g., including the whipstock assembly 2025, the anchoring assembly 2030, the liner assembly 2035, and the two part drilling and running tool 2040) is positioned downhole within the wellbore 2010 in a single run. When the downhole tool 2020 has landed, the anchoring mechanism 2030 may be set to fix the liner assembly 2035 within the wellbore 2010. For example, a hanger and latch coupling may be used to fix the liner assembly 2035 within the wellbore 2010. In certain other embodiments, the anchoring mechanism 2030 also includes a packing element. The packing element may be self-energizing (swell packer), or alternatively may be part of the anchoring mechanism 2030 or whipstock assembly 2025, and set once they are in their final position.

Figure 20B:
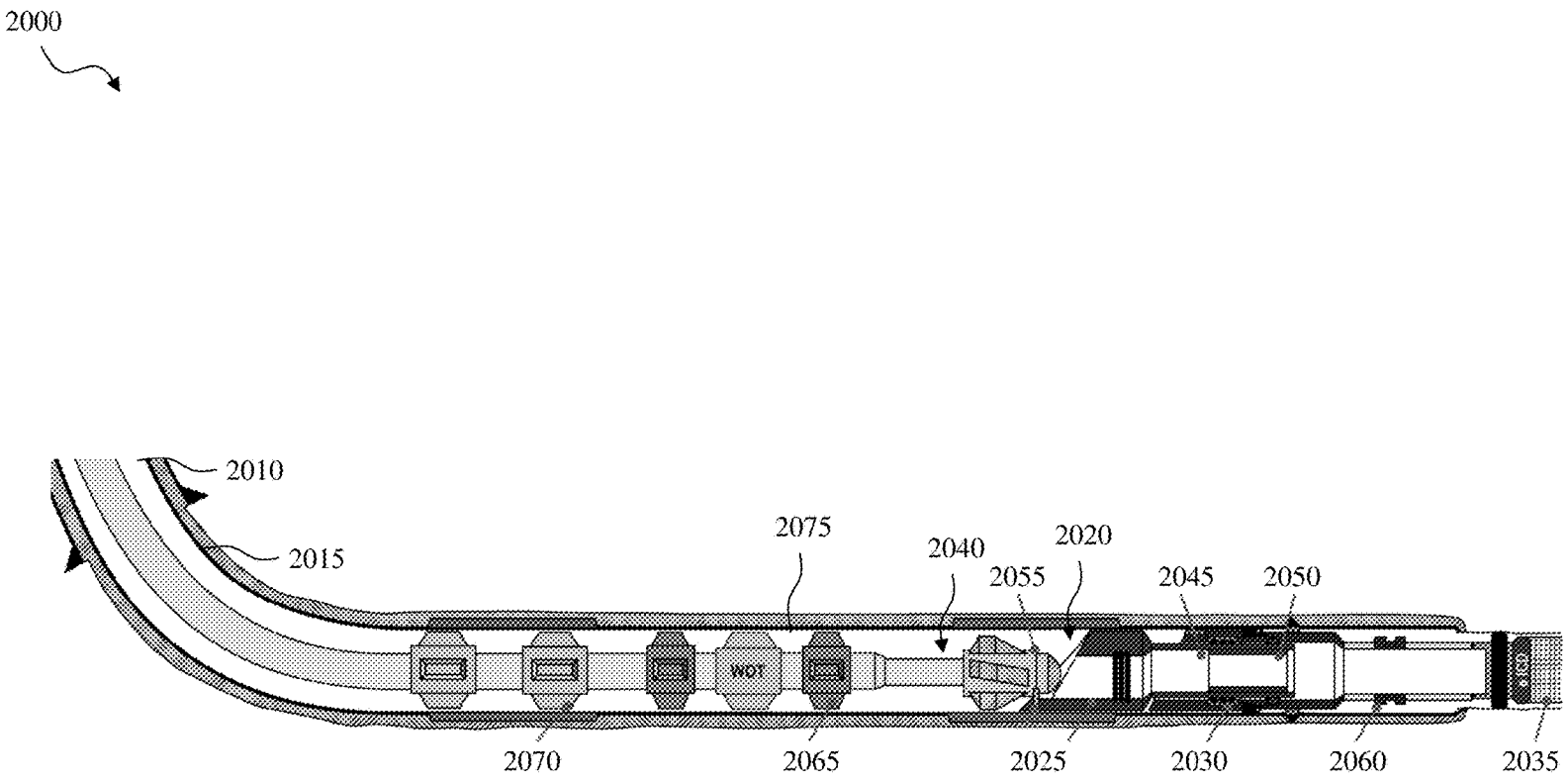

Once the liner assembly 2035 is on depth and lands in the anchoring mechanism 2030, the smaller assembly 2050 may be turned (e.g., right hand turned) to detach itself from the liner assembly 2035. Thereafter, the smaller assembly 2050 may be pulled up to engage the larger bit assembly 2055, and turned (e.g., right hand turned) to make up the smaller assembly 2050 to the larger bit assembly 2055 via the collection of threads (e.g., collection of left hand threads) on both pieces, as shown in FIG. 20B. Once the smaller assembly 2050 bottoms out, an optional snap ring device can engage to hold both together. Once attached, the orientation of the whipstock assembly 2030 can be determined, for example because the two part drilling and running tool 2040 is attached to the whipstock assembly 2025 via the shear bolt. In at least one embodiment, the smaller assembly 2050 and the larger bit assembly 2055 are timed so that the orientation of the whipstock assembly 2030 can be determined by the orientation tool 2075. Thereafter, the shear bolt may be sheared, and the downhole tool 2020 may be used to form an opening in the casing 2015 and/or drill a lateral wellbore from the wellbore 2010.

Figure 21:
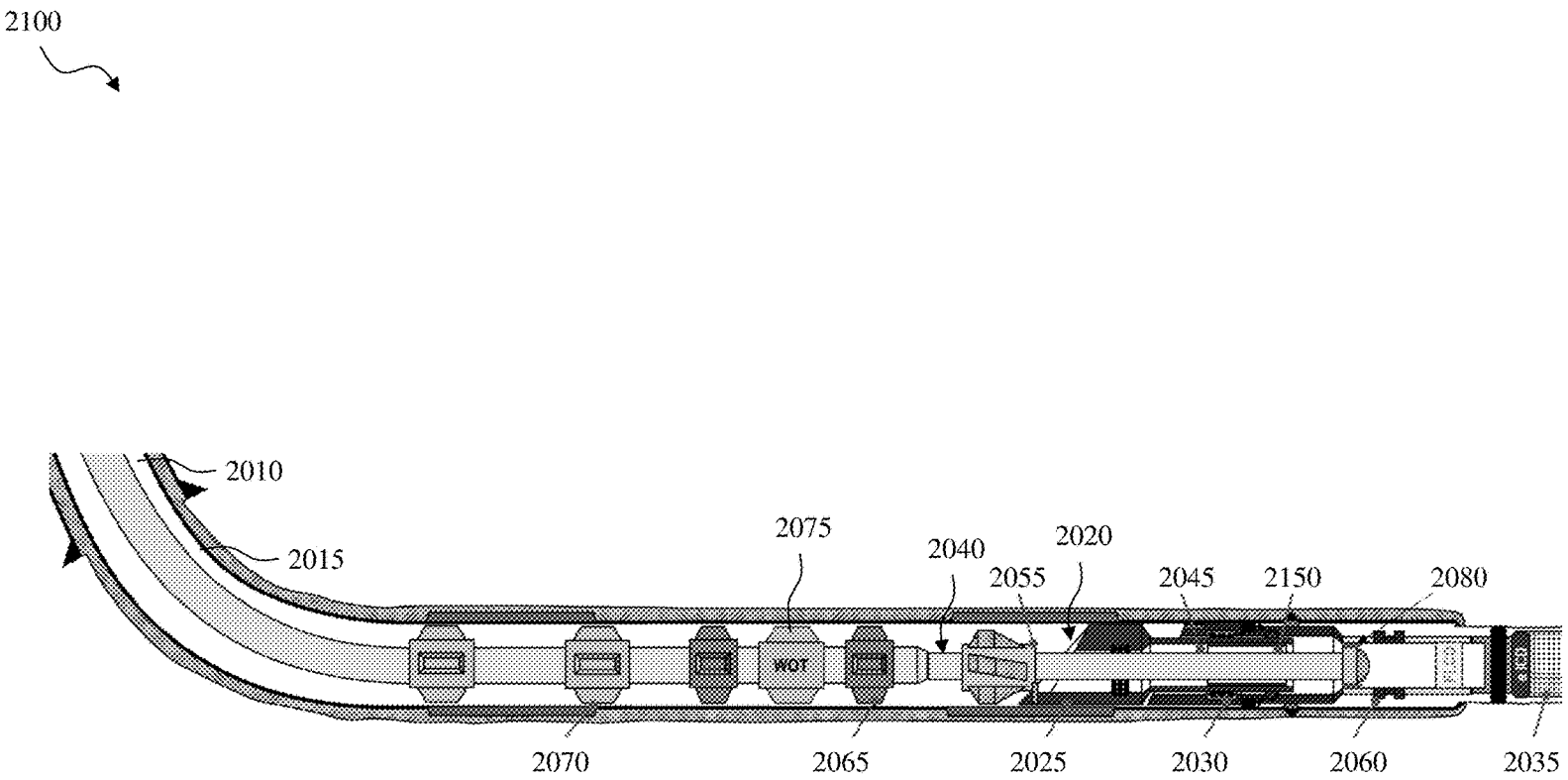
FIG. 21 illustrates a well system designed, manufactured and operated according to another embodiment of the disclosure, the well system employing a two part drilling and running tool.

Turning to FIG. 21, illustrated is a side view of a well system 2100 designed, manufactured and operated according to one or more alternative embodiments of the disclosure. The well system 2100 is similar in many respects to the well system 2000 of FIG. 20A. Accordingly, like reference numbers have been used to indicated similar, if not identical, features. The well system 2100 differs, for the most part, from the well system 2000, in that the well system 2100 couples its smaller assembly 2150 uphole of the swivel assembly 2060, for example either in the anchoring assembly 2030 or between the anchoring assembly 2030 and the swivel 2060. In at least this one embodiment, the two part drilling and running tool 2040, in part due to the smaller assembly 2050 being coupled uphole of the swivel mechanism 2060, may rotate freely of the liner assembly 2035 as the downhole tool 2020 is being run in hole, and prior to the anchoring assembly 2030 being set.

Figure 22:
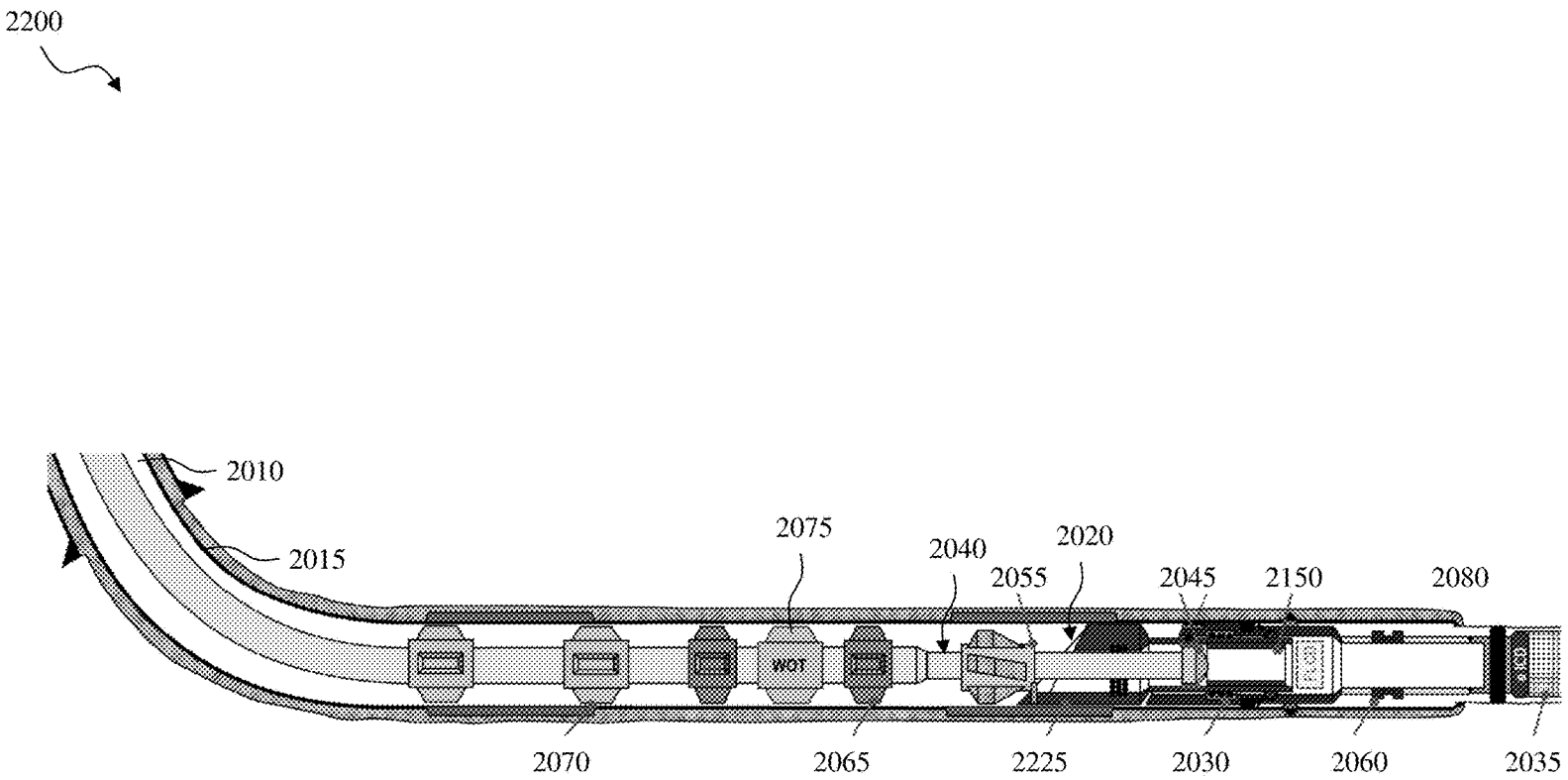
FIG. 22 illustrates a well system designed, manufactured and operated according to yet another embodiment of the disclosure, the well system employing a two part drilling and running tool.

Turning to FIG. 22, illustrated is a side view of a well system 2200 designed, manufactured and operated according to one or more alternative embodiments of the disclosure. The well system 2200 is similar in many respects to the well system 2000 of FIG. 20A. Accordingly, like reference numbers have been used to indicated similar, if not identical, features. The well system 2200 differs, for the most part, from the well system 2000, in that the well system 2200 couples its smaller assembly 2150 uphole of the swivel assembly 2060, for example proximate a downhole end of the whipstock assembly 2225.

Aspects disclosed herein include:

A. A two part drilling and running tool, the two part drilling and running tool including 1) a conveyance; 2) a smaller assembly coupled to an end of the conveyance, the smaller assembly having a collection of threads located proximate a downhole end thereof, the collection of threads configured to help engage and/or disengage from a wellbore tool positioned there below; and 3) a larger bit assembly slidably coupled to the conveyance, the smaller assembly and larger bit assembly configured to slidingly engage one another downhole to form a combined bit assembly.

B. A downhole tool, the downhole tool including: 1) a two part drilling and running tool, comprising: a) a conveyance; b) a smaller assembly coupled to an end of the conveyance, the smaller assembly having a collection of threads located proximate a downhole end thereof; and c) a larger bit assembly slidably coupled to the conveyance, the smaller assembly and larger bit assembly configured to slidingly engage one another downhole to form a combined bit assembly; 2) a whipstock assembly coupled to the two part drilling and running tool using a coupling mechanism; 3) an anchoring assembly coupled downhole of the whipstock assembly; and 4) a wellbore liner coupled downhole of the anchoring assembly, and further wherein the collection of threads are configured to help engage and/or disengage from one of the whipstock assembly, the anchoring assembly or the wellbore liner.

C. A well system, the well system including: 1) a main wellbore located within a subterranean formation; and 2) a downhole tool positioned within the main wellbore, the downhole tool including: a) a two part drilling and running tool, the two part drilling and running tool including: i) a conveyance; ii) a smaller assembly coupled to an end of the conveyance, the smaller assembly having a collection of threads located proximate a downhole end thereof; and iii) a larger bit assembly slidably coupled to the conveyance, the smaller assembly and larger bit assembly configured to slidingly engage one another downhole to form a combined bit assembly; b) a whipstock assembly coupled to the two part drilling and running tool using a coupling mechanism; c) an anchoring assembly coupled downhole of the whipstock assembly; and d) a wellbore liner coupled downhole of the anchoring assembly, and further wherein the collection of threads are configured to help engage and/or disengage from one of the whipstock assembly, the anchoring assembly or the wellbore liner.

D. A method for forming a well system, the method including: 1) forming a wellbore within a subterranean formation; 2) positioning a downhole tool within the wellbore, the downhole tool including: a) a two part drilling and running tool, the two part drilling and running tool including: i) a conveyance; ii) a smaller assembly coupled to an end of the conveyance, the smaller assembly having a collection of threads located proximate a downhole end thereof; and iii) a larger bit assembly slidably coupled to the conveyance, the smaller assembly and larger bit assembly configured to slidingly engage one another downhole to form a combined bit assembly; b) a whipstock assembly coupled to the two part drilling and running tool using a coupling mechanism; c) an anchoring assembly coupled downhole of the whipstock assembly; and d) a wellbore liner coupled downhole of the anchoring assembly, and further wherein the collection of threads are configured to help engage and/or disengage from one of the whipstock assembly, the anchoring assembly or the wellbore liner; 3) rotating the conveyance to disengage the collection of threads from the one of the whipstock assembly, the anchoring assembly or the wellbore liner; and 4) retracting the smaller assembly that has disengaged from the one of the whipstock assembly, the anchoring assembly or the wellbore liner uphole, the smaller assembly engaging with the larger bit assembly to form the combined bit assembly.

Aspects A, B, C and D may have one or more of the following additional elements in combination: Element 1: wherein the collection of threads are a first collection of left hand threads configured to help engage and/or disengage from a second collection of left hand threads in the wellbore tool. Element 2: wherein the conveyance is a right hand conveyance, such that a right hand twisting of the right hand conveyance is configured to disengage the smaller assembly from the wellbore tool. Element 3: wherein the larger bit assembly has a third collection of left hand threads, the first collection of threads and the third collection of threads configured to engage one another to rotationally and axially fix the smaller assembly with the larger bit assembly to form the combined bit assembly. Element 4: wherein the first collection of threads and the third collection of threads are configured to engage one another to rotationally and axially fix the smaller assembly with the larger bit assembly with the right hand twisting of the conveyance. Element 5: wherein the smaller assembly is a smaller bit assembly. Element 6: wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together. Element 7: wherein the smaller bit assembly includes the lock ring profile and the larger bit assembly includes the lock ring. Element 8: wherein the smaller bit assembly includes one or more fluid ports, the one or more fluid ports configured to hydraulically actuate an anchoring assembly. Element 9: wherein the collection of threads are a first collection of right hand threads configured to help engage and/or disengage from a second collection of right hand threads in the wellbore tool, and further wherein the conveyance is a left hand conveyance, such that a left hand twisting of the left hand conveyance is configured to disengage the smaller assembly from the wellbore tool. Element 10: further including a swivel positioned between the anchoring assembly and the wellbore liner. Element 11: wherein the collection of threads are a first collection of left hand threads configured to help engage and/or disengage from a second collection of left hand threads in the wellbore liner. Element 12: wherein the conveyance is a right hand conveyance, such that a right hand twisting of the right hand conveyance is configured to disengage the smaller assembly from the wellbore liner. Element 13: wherein the collection of threads are a first collection of left hand threads configured to help engage and/or disengage from a second collection of left hand threads in the anchoring assembly. Element 14: wherein the conveyance is a right hand conveyance, such that a right hand twisting of the right hand conveyance is configured to disengage the smaller assembly from the anchoring assembly. Element 15: wherein the collection of threads are a first collection of left hand threads configured to help engage and/or disengage from a second collection of left hand threads in the whipstock assembly. Element 16: wherein the conveyance is a right hand conveyance, such that a right hand twisting of the right hand conveyance is configured to disengage the smaller assembly from the whipstock assembly. Element 17: wherein the coupling mechanism is a shear feature coupling the larger bit assembly to the whipstock assembly. Element 18: wherein the collection of threads are a first collection of left hand threads configured to help engage and/or disengage from a second collection of left hand threads located in a bushing positioned in one of the whipstock assembly, the anchoring assembly or the wellbore liner.

Those skilled in the art to which this application relates will appreciate that other and further additions, deletions, substitutions and modifications may be made to the described embodiments.

What is claimed is:

1. A two part drilling and running tool, comprising:

a conveyance;

a smaller assembly having a cutting diameter (ds) coupled to an end of the conveyance, the smaller assembly having a collection of threads on an outer surface thereof located proximate a downhole end thereof, the collection of threads configured to help engage and/or disengage from a wellbore tool positioned there below; and a larger bit assembly having a cutting diameter (dl) and a plurality of cutting features thereon slidably coupled to the conveyance, the cutting diameter (ds) less than the cutting diameter (dl), the smaller assembly and larger bit assembly configured to slidingly engage one another while downhole to form a combined bit assembly.

2. The two part drilling and running tool as recited in claim 1, wherein the collection of threads are a first collection of left hand threads configured to help engage and/or disengage from a second collection of left hand threads in the wellbore tool.

3. The two part drilling and running tool as recited in claim 2, wherein the conveyance is a right hand conveyance, such that a right hand twisting of the right hand conveyance is configured to disengage the smaller assembly from the wellbore tool.

4. The two part drilling and running tool as recited in claim 3, wherein the larger bit assembly has a third collection of left hand threads on an inner surface thereof, the first collection of threads and the third collection of threads configured to engage one another to rotationally and axially fix the smaller assembly with the larger bit assembly to form the combined bit assembly.

5. The two part drilling and running tool as recited in claim 4, wherein the first collection of threads and the third collection of threads are configured to engage one another to rotationally and axially fix the smaller assembly with the larger bit assembly with the right hand twisting of the conveyance.

6. The two part drilling and running tool as recited in claim 1, wherein the smaller assembly is a smaller bit assembly.

7. The two part drilling and running tool as recited in claim 6, wherein the smaller bit assembly includes one of a lock ring profile or a lock ring, and the larger bit assembly includes an other of the lock ring or the lock ring profile, the lock ring profile and lock ring configured to engage with one another to slidingly fix the smaller bit assembly with the larger bit assembly when the two are slidingly engaged together.

8. The two part drilling and running tool as recited in claim 7, wherein the smaller bit assembly includes the lock ring profile and the larger bit assembly includes the lock ring.

9. The two part drilling and running tool as recited in claim 2, wherein the smaller bit assembly includes one or more fluid ports, the one or more fluid ports configured to hydraulically actuate an anchoring assembly.

10. The two part drilling and running tool as recited in 1, wherein the collection of threads are a first collection of right hand threads configured to help engage and/or disengage from a second collection of right hand threads in the wellbore tool, and further wherein the conveyance is a left hand conveyance, such that a left hand twisting of the left hand conveyance is configured to disengage the smaller assembly from the wellbore tool.

11. A downhole tool, comprising:

a two part drilling and running tool, comprising:

a conveyance;

a smaller assembly having a cutting diameter (ds) coupled to an end of the conveyance, the smaller assembly having a collection of threads on an outer surface thereof located proximate a downhole end thereof; and a larger bit assembly having a cutting diameter (dl) and a plurality of cutting features thereon slidably coupled to the conveyance, the cutting diameter (ds) less than the cutting diameter (dl), the smaller assembly and larger bit assembly configured to slidingly engage one another while downhole to form a combined bit assembly;

a whipstock assembly coupled to the two part drilling and running tool using a coupling mechanism;

an anchoring assembly coupled downhole of the whipstock assembly; and a wellbore liner coupled downhole of the anchoring assembly, and further wherein the collection of threads are configured to help engage and/or disengage from one of the whipstock assembly, the anchoring assembly or the wellbore liner.

12. The downhole tool as recited in claim 11, further including a swivel positioned between the anchoring assembly and the wellbore liner.

13. The downhole tool as recited in claim 12, wherein the collection of threads are a first collection of left hand threads configured to help engage and/or disengage from a second collection of left hand threads in the wellbore liner.

14. The downhole tool as recited in claim 13, wherein the conveyance is a right hand conveyance, such that a right hand twisting of the right hand conveyance is configured to disengage the smaller assembly from the wellbore liner.

15. The downhole tool as recited in claim 12, wherein the collection of threads are a first collection of left hand threads configured to help engage and/or disengage from a second collection of left hand threads in the anchoring assembly.

16. The downhole tool as recited in claim 15, wherein the conveyance is a right hand conveyance, such that a right hand twisting of the right hand conveyance is configured to disengage the smaller assembly from the anchoring assembly.

17. The downhole tool as recited in claim 12, wherein the collection of threads are a first collection of left hand threads configured to help engage and/or disengage from a second collection of left hand threads in the whipstock assembly.

18. The downhole tool as recited in claim 17, wherein the conveyance is a right hand conveyance, such that a right hand twisting of the right hand conveyance is configured to disengage the smaller assembly from the whipstock assembly.

19. The downhole tool as recited in claim 11, wherein the coupling mechanism is a shear feature coupling the larger bit assembly to the whipstock assembly.

20. The downhole tool as recited in claim 11, wherein the collection of threads are a first collection of left hand threads configured to help engage and/or disengage from a second collection of left hand threads located in a bushing positioned in one of the whipstock assembly, the anchoring assembly or the wellbore liner.

21. A well system, comprising:

a main wellbore located within a subterranean formation; and a downhole tool positioned within the main wellbore, the downhole tool including:

a two part drilling and running tool, the two part drilling and running tool including:

a conveyance;

a smaller assembly having a cutting diameter (ds) coupled to an end of the conveyance, the smaller assembly having a collection of threads on an outer surface thereof located proximate a downhole end thereof; and a larger bit assembly having a cutting diameter (dl) and a plurality of cutting features thereon slidably coupled to the conveyance, the cutting diameter (ds) less than the cutting diameter (dl), the smaller assembly and larger bit assembly configured to slidingly engage one another while downhole to form a combined bit assembly;

a whipstock assembly coupled to the two part drilling and running tool using a coupling mechanism;

an anchoring assembly coupled downhole of the whipstock assembly; and a wellbore liner coupled downhole of the anchoring assembly, and further wherein the collection of threads are configured to help engage and/or disengage from one of the whipstock assembly, the anchoring assembly or the wellbore liner.

22. A method for forming a well system, comprising:

forming a wellbore within a subterranean formation;

positioning a downhole tool within the wellbore, the downhole tool including:

a two part drilling and running tool, the two part drilling and running tool including:

a conveyance;

a smaller assembly having a cutting diameter (ds) coupled to an end of the conveyance, the smaller assembly having a collection of threads on an outer surface thereof located proximate a downhole end thereof; and a larger bit assembly having a cutting diameter (dl) and a plurality of cutting features thereon slidably coupled to the conveyance, the cutting diameter (ds) less than the cutting diameter (dl), the smaller assembly and larger bit assembly configured to slidingly engage one another while downhole to form a combined bit assembly;

a whipstock assembly coupled to the two part drilling and running tool using a coupling mechanism;

an anchoring assembly coupled downhole of the whipstock assembly; and a wellbore liner coupled downhole of the anchoring assembly, and further wherein the collection of threads are configured to help engage and/or disengage from one of the whipstock assembly, the anchoring assembly or the wellbore liner;

rotating the conveyance to disengage the collection of threads from the one of the whipstock assembly, the anchoring assembly or the wellbore liner; and retracting the smaller assembly that has disengaged from the one of the whipstock assembly, the anchoring assembly or the wellbore liner uphole, the smaller assembly engaging with the larger bit assembly to form the combined bit assembly.

* * * * *